US006336705B1

(12) United States Patent
Torigoe

(10) Patent No.: US 6,336,705 B1
(45) Date of Patent: Jan. 8, 2002

(54) INK-JET RECORDING METHOD, APPARATUS THEREFOR, CONTROL METHOD OF SAID APPARATUS AND MACHINE-READABLE STORING MEDIUM

(75) Inventor: Makoto Torigoe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/422,789

(22) Filed: Oct. 22, 1999

(30) Foreign Application Priority Data

Oct. 27, 1998 (JP) ..... 10-305284
Sep. 20, 1999 (JP) ..... 11-265381

(51) Int. Cl.[7] ..... B41J 2/21
(52) U.S. Cl. ..... 347/43; 347/15; 347/100
(58) Field of Search ..... 347/40, 41, 42, 347/43, 12, 15, 14, 100, 101, 105, 95

(56) References Cited

U.S. PATENT DOCUMENTS 4,313,124 A 1/1982 Hara ..... 346/140
4,345,262 A 8/1982 Shirato et al. ..... 346/140
4,459,600 A 7/1984 Sato et al. ..... 346/140
4,463,359 A 7/1984 Ayata et al. ..... 346/1.1
4,558,333 A 12/1985 Sugitani et al. ..... 346/140
4,723,129 A 2/1988 Endo et al. ..... 346/1.1
4,740,796 A 4/1988 Endo et al. ..... 346/1.1
4,788,563 A * 11/1988 Omo et al. ..... 347/14
5,017,227 A * 5/1991 Koike et al. ..... 106/22
5,101,218 A * 3/1992 Sakaki et al. ..... 347/105
5,732,153 A 3/1998 Ohsawa ..... 382/191
6,027,210 A * 2/2000 Kurabayashi et al. ..... 347/100
6,033,463 A * 3/2000 Yui et al. ..... 106/31.27
6,104,829 A * 8/2000 Nakajima ..... 382/167
6,128,098 A * 10/2000 Kamada et al. ..... 347/40

FOREIGN PATENT DOCUMENTS

JP 56-147859 11/1981
JP 56-147860 11/1981
JP 59-123670 7/1984
JP 59-138461 8/1984
JP 60-71260 4/1985
JP 4-307271 10/1992
JP 5-23955 2/1993

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

The present invention provides an ink-jet recording method and an apparatus therefor which have a sufficient print density for various kinds of recording medium and permit recording of a high-quality image excellent in durability. For this purpose, black ink in which the coloring agent is a pigment and at least cyan, magenta and yellow color ink in which the coloring agents are dyes are prepared, and the kind and ratio of the ink used is changed in response to the kind of recording medium and the printing mode, taking account of the properties of the pigment ink and the dye ink.

25 Claims, 10 Drawing Sheets

FIG. 3

| RECORDING MEDIUM | COLOR MODE | GREY SCALE MODE |
|---|---|---|
| GLOSSY MEDIUM | RECORDING WITH THREE COLORS CMY NOT USING K | RECORDING WITH K ALONE |
| BACK VIEWING MEDIUM | RECORDING WITH THREE COLORS CMY NOT USING K | RECORDING WITH THREE COLORS CMY |
| OHP SHEET | RECORDING WITH FOUR COLOR CMYK | RECORDING WITH FOUR COLOR CMYK |
| POSTCARD | RECORDING WITH FOUR COLOR CMYK | RECORDING WITH K ALONE |
| PLAIN PAPER | RECORDING WITH FOUR COLOR CMYK | RECORDING WITH K ALONE |

INK-JET RECORDING METHOD, APPARATUS THEREFOR, CONTROL METHOD OF SAID APPARATUS AND MACHINE-READABLE STORING MEDIUM

BACKGROUND OF THE INVENTION

1. Field of the Invention

The present invention relates to an ink jet recording method and an ink jet recording apparatus for recording a color image or a monochromatic image by the simultaneous use of pigment ink and dye ink, a control method of such an apparatus, and a machine-readable storing medium.

2. Description of the Related Art

The ink jet recording method comprise the steps of producing ink droplets by the application of any of various ink discharge processes such as the electrostatic sucking process based on application of a high voltage, a process of imparting a mechanical vibration or a displacement to the ink (coloring ink) by the use of a piezo-electric element, or a process using the pressure causing bubbling of the ink upon heating it, causing such droplets to fly to adhere to a recording medium such as a sheet of paper, and forming ink dots, thereby accomplishing recording. This method is advantageous in inconspicuous generation of noise during recording, and availability of a high-resolution recorded image at a high speed by using a high-integration head.

For the ink jet recording method as described above, it has been the conventional practice to use dye ink prepared by dissolving various water-soluble dyes in water or in a mixed solution of water and an organic solvent. However, an image recorded with dye ink has often been defective in durability such as light fastness and water resistance. Particularly regarding black popularly used in public documents, a particularly high durability has been demanded as compared with the other colors.

On the other hand, pigment ink prepared by dissolving a pigment dispersion solution made by dispersing a pigment in a polymer dispersant into a water-soluble solvent is disclosed in Japanese Patent Laid-Open No. 56-147859 and Japanese Patent Laid-Open No. 56-147860. Because pigment ink has more excellent properties than those of dye ink in water resistance as well as in light fastness, various kinds of pigment ink have so far been studied, and more recently, there is known an ink jet printer having particularly a printing quality improved by using pigment ink.

The reason of the improvement of printing quality brought about by using pigment ink will be briefly described. Particles of the coloring agent in a pigment are larger in size than those of a dye, resulting in difficulty to penetrate into depth of texture of plain paper or the like, and in stagnation near the surface. As a result, the printing density is high, with slighter penetration into areas surrounding the print, thus boundaries are clearly and distinctly printed.

Under the present circumstances, however, it is very difficult to materialize pigment ink for colors other than black in terms of coloring. Many of the ink jet printers adopting pigment ink therefore use pigment ink only for black ink and employ dye ink as color ink (generally, cyan, magenta and yellow).

Recording media onto which recording is possible by an ink-jet printer include, apart from plain paper, ink-jet recording paper, a postcard, cloth, glossy paper, a glossy film made of plastics, a transparent sheet used for projecting with a projector (hereinafter referred to as an "OHP sheet"), a back-printed film having an ink receiving layer provided on a side of a substrate, to be viewed from a side opposite to the surface having the ink receiving layer, and a transfer medium used for transferring a recorded surface onto cloth or a sheet, and these media are used for various applications. Among others, each of the ink-jet recording paper, the glossy paper, the glossy film, the OHP sheet, the back-printed film and the transfer medium has generally an ink receiving layer for absorbing the ink on the substrate.

In the case of dye ink, in which coloring is accomplished by a dye staining the recording medium, the surface condition of the recording medium exerts only a slight effect on the image density. In the case of pigment ink, in contrast, in which the pigment aggregate near the surface of the recording medium and solidify there, the surface condition of the recording medium exerts an important effect on the image density. The pigment ink tends to have a rough recorded surface after fixing because particles of the coloring agent and large in size as described above as a result of properties thereof.

Inconveniences have therefore been encountered for the pigment ink in a serious deterioration of the image density and a lower image quality, depending upon the kind of the recording medium.

For example, recording on a recording medium having originally a rough surface such a plain paper poses no problem. However, recording on a special glossy medium such as glossy paper or a glossy film leads to loss of the original glossy of the medium, thus resulting in an undesirable dots quality. Particularly when recording simultaneously with dye color ink, non-glossy dots are locally produced in dark portions of the image which gives a strong feeling of strangeness. This problem is not limited to glossy media, but the same problem, although to a smaller extent, is encountered in a coated sheet of paper having an ink receiving layer provided on the substrate such as special glossy ink-jet paper. This attributable to the fact that, since the ink receiving layer smoothens irregularities of the paper surface, roughness of pigment ink particles is serious, though not so much as in a glossy medium.

In the case of a recording medium, having an ink receiving layer on a side of the substrate as described above, to be viewed from a side opposite to the surface having the ink receiving layer (such as a back-printed film), recording even with pigment ink results in a hardly visible image, and a sufficient print density is unavailable. The pigment ink does not sufficiently penetrate into the ink receiving layer and remains near the surface, thus making it difficult for the pigment ink to penetrate and reach the side opposite to the recorded surface.

When recording an image on a plastic sheet having an ink receiving layer with pigment ink, cracks may occur on the recorded surface after fixing, depending upon the kind of the pigment, the ink composition, and the material and structure of the ink receiving layer. Particularly in an OHP sheet, which is projected in an enlarged size by an overhead projector, cracks are clearly visible. Such cracks lead to a lower image quality.

Causes of cracking will now be briefly described. In general, the ink receiving layer on the surface of an OHP sheet for ink-jet printer has a mechanism of absorbing the ink by swelling. On the other hand, the pigment ink is not absorbed as much, from its nature, by the ink receiving layer because of the large particle size of the coloring agent, and stays on the surface of the receiving layer. As a result, pigment particles combine together and form a layer on the surface, and then dried. The ink receiving layer swelling by sucking the ink solvent pushes up this layer, and this is considered to cause cracking.

Further, the pigment ink is inferior in frictional wear resistance to the dye ink because the pigment ink is fixed near the surface of the medium, and tends to come off by frictions. A medium usually recorded on the both sides such as a postcard is loaded on a auto-sheet feeder after recording a side for recording on the other side, at this point, the pigment ink recorded on the back of the postcard may adhere to the next sheet of paper.

SUMMARY OF THE INVENTION

To solve the aforementioned problems, the present invention has an object to provide a method of recording a high-quality image to any of a various types of recording medium, an apparatus therefore, a control method of the apparatus and a machine-readable storing medium.

Another object of the invention is to provide a method of recording an image having a sufficient print density and excellent in durability by making full use of properties of pigment ink, an apparatus therefor, a control method of the apparatus and machine-readable storing medium.

For the purpose of achieving the above-mentioned objects, the ink jet recording method of the first aspect of the invention is characterized by the following configuration.

More specifically, the ink jet recording method for recording an image onto a recording medium by using a black ink including a black pigment and color inks including at least cyan, magenta and yellow dyes, comprising the steps of: providing the recording medium having a substrate and an ink receiving layer provided onto a side of the substrate, the recording medium being viewed from a side opposite to the substrate to the surface having the ink receiving layer: and performing recording onto the recording medium using the color inks alone without using said black ink, when any of a monochromatic image and a color image of a plurality of colors is recorded onto the recording medium.

The ink-jet recording apparatus of the second aspect of the invention is characterized by the following configuration.

The ink jet recording apparatus for recording an image onto a recording medium by scanning an ink jet head having discharge portions discharging a black ink including a black pigment and color inks including at least cyan, magenta and yellow dyes, relative to the recording medium, the apparatus comprising: driving means for driving the ink jet head such that recording is performed using the color inks discharge portion alone without using the black ink discharge portion, when any of a monochromatic image and a color image of a plurality of colors is recorded onto the recording medium, and when the recording medium has a substrate and an ink receiving layer provided onto a side of the substrate, the recording medium is to be viewed from a side opposite to the substrate to the surface having the ink receiving layer.

The ink-jet recording method of the third aspect of the invention is characterized by the following configuration.

The ink jet recording method for recording an image onto a recording medium by using a black ink including a black pigment and color inks including at least cyan, magenta and yellow dyes, comprising the steps of: providing a light-transmissive recording medium having an ink receiving layer; and recording a black region of a maximum density onto the recording medium using the black ink with the color inks, wherein an area of from 30 to 70% of the maximum density black region is formed with the black ink and a rest areas of the maximum density black region is formed with the cyan, magenta and yellow dyes.

The ink-jet recording method of the fourth aspect of the invention is characterized by the following configuration.

The ink jet recording method for recording an image onto a recording medium by using a black ink including a black pigment and color inks including at least cyan, magenta and yellow dyes, comprises the steps of: providing a light-transmissive recording medium having an ink receiving layer; and recording a black region onto the recording medium using the black ink with color inks.

The ink jet recording apparatus is for recording an image onto a recording medium by scanning an ink jet head having discharge portions discharging a black ink including a black pigment and color inks including at least cyan, magenta and yellow dyes, relative to the recording medium, the apparatus comprising: driving means for driving the ink jet head such that recording is performed using the black ink discharge portion with the color ink discharge portion, when a black region of a maximum density is recorded onto a light-transmissive recording medium having an ink receiving layer, wherein an area of from 30 to 70% of the maximum density black region is formed with the black ink and a rest areas of the maximum density black region is formed with the cyan, magenta and yellow dyes.

The ink-jet recording apparatus of the sixth aspect of the invention is characterized by the following configuration.

The ink jet recording apparatus is for recording an image onto a recording medium by scanning an ink jet head having a discharge portion discharging a black ink including a black pigment and color inks including at least cyan, magenta and yellow dyes, relative to the recording medium, the apparatus comprising: driving means for driving the ink jet head such that recording is performed using the black ink discharge portion with the color ink discharge portion, when a black region is recorded onto a light-transmissive recording medium having an ink receiving layer.

The ink-jet recording method of the seventh aspect of the invention is characterized by the following configuration.

The ink-jet recording method is for recording an image onto a postcard by using a black ink including a black pigment and color inks including at least cyan, magenta and yellow dyes, comprising the steps of: providing a postcard; and recording a black region of a color image onto the postcard using the black ink with the color inks, wherein an area of from at least 40 to less than 90% of the black region is formed with the black ink and a rest area of the black region is formed with the cyan, magenta and yellow dyes.

The ink-jet recording apparatus of the eight aspect of the invention is characterized by the following configuration.

The ink jet recording apparatus is for recording an image onto a postcard by scanning an ink jet head having discharge portions discharging a black ink including a black pigment and color inks including at least cyan, magenta and yellow dyes, relative to the recording medium, the apparatus comprising: driving means for driving the ink jet head such that recording is performed using the black ink discharge portion with the color inks discharge portion, when a black region of a color image is recorded onto the postcard; wherein an area of from at least 40 to less than 90% of the black region is formed with the black ink and a rest area of the black region is formed with the cyan, magenta and yellow dyes.

The ink-jet recording method of the ninth aspect of the invention is characterized by the following configuration.

The ink jet recording method for recording an image onto a recording medium by using a black ink including a black pigment and color inks including at least cyan, magenta and yellow dyes, comprises the steps of: providing the recording medium having an ink receiving layer provided onto an opaque substrate, performing recording onto the recording medium using the black ink alone without using the color inks when a monochromatic image is recorded onto the recording medium, recording onto the recording medium using the color inks alone without using said black ink when a color image of a plurality of colors is recorded onto the recording medium.

The ink-jet recording apparatus of the tenth aspect of the invention is characterized by the following configuration.

The ink jet recording apparatus is for recording an image onto a recording medium by scanning an ink jet head having discharge portions discharging a black ink including a black pigment and color inks including at least cyan, magenta and yellow dyes, relative to the recording medium, the apparatus comprising: driving means for driving the ink jet head such that recording is performed using the black ink discharge portion alone without using the color inks discharge portion when a monochromatic image is recorded onto the recording medium having an ink receiving layer provided onto an opaque substrate, recording is performed using the color inks discharge portion alone without using the black ink discharge portion when a color image of a plurality of colors is recorded onto the recording medium having an ink receiving layer provided onto an opaque substrate.

The ink-jet recording method of the eleventh aspect of the invention is characterized by the following configuration.

The ink-jet recording method comprises the steps of preparing black ink including a black pigment and color ink including at least cyan, magenta and yellow dyes, and recording an image on a recording medium; wherein: (a) when conducting recording on a recording medium having an ink receiving layer provided on a substrate, having a glossy surface: the black ink alone is used without the use of the color ink when recording a monochromatic image on the glossy recording medium; and the color ink alone is used without the use of the black ink when recording a color image of a plurality of colors on the glossy recording medium; (b) when conducting recording on an OHP sheet: recording is accomplished by the simultaneous use of the black ink and the color ink when recording any of a monochromatic image or a color image of a plurality of colors on the OHP sheet; (c) when conducting recording on a postcard: the black ink alone is used without the use of the color ink when recording a monochromatic image on the postcard; and recording is accomplished by the simultaneous use of the black ink and the color ink when recording a color image of plurality of colors on the postcard; and (d) when conducting recording on a recording medium having an ink receiving layer on a side of the substrate for viewing from a side opposite to the surface having the ink receiving layer: recording is accomplished by using the color ink alone without the use of the black ink when recording any of a monochromatic image and a color image of a plurality of colors on a recording medium for viewing from a side opposite to the surface having the ink receiving layer.

The ink-jet recording apparatus of the twelfth aspect of the invention is characterized by the following configuration.

The ink jet recording apparatus is for recording an image on a recording medium by scanning a discharge section discharging black ink including a black pigment and another discharge section discharging color ink including at least cyan, magenta and yellow dyes, relative to the recording medium; wherein the ink jet recording apparatus has recording control means controlling performance of recording in any of the following first to fourth recording modes: (a) when conducting recording on the recording medium having an ink receiving layer, having a glossy surface, on a substrate: a first recording mode of conducting recording, when recording a monochromatic image on the glossy recording medium, by using the black ink discharge section alone without the use of the color ink discharge section; and conducting recording, when recording a color image of a plurality of colors on the glossy recording medium, by using the color ink discharge section alone without the use of the black ink discharge section; (b) when conducting recording on an OHP sheet: a second recording mode of conducting recording, when recording any of a monochromatic image and a color image of a plurality of colors, by the simultaneous use of the black ink discharge section and the color ink discharge section; (c) when conducting recording on a postcard: a third recording mode of conducting recording, when recording a monochromatic image on the postcard, by using the black ink discharge section alone without the use of the color ink discharge section; and conducting recording, when recording a color image of a plurality of colors on the postcard, by the simultaneous use of the black ink discharge section and the color ink discharge section; and (d) when conducting recording on a medium for viewing from a side opposite to the surface having the ink receiving layer provided on one side of the substrate: a fourth recording mode of conducting recording, when recording any of a monochromatic image and a color image on a recording medium to be viewed from the side opposite to the surface having the ink receiving layer, by using the color ink discharge section alone without the use of the black ink discharge section.

The control method of the ink-jet recording apparatus of the thirteenth aspect of the invention is characterized by the following configuration.

The method of controlling an ink jet recording apparatus for recording an image onto a recording medium by scanning an ink jet head having discharge portions discharging a black ink including a black pigment and color inks including at least cyan, magenta and yellow dyes, relative to the recording medium, comprises the steps of: providing the recording medium having a substrate and an ink receiving layer provided onto a side of the substrate, the recording medium being viewed from a side opposite to the substrate to the surface having the ink receiving layer; and controlling the ink jet recording apparatus such that recording onto the recording medium is performed using the color inks alone without using the black ink, when any of a monochromatic image and a color image of a plurality of colors is recorded onto the recording medium.

The machine-readable storing medium of the fourteenth aspect of the invention is characterized by the following configuration.

The machine-readable storing medium is to store programcode for executing reading control processing of an ink jet recording system for recording an image onto a recording medium by scanning an ink jet head having discharge portions discharging a black ink including a black pigment and color inks including at least cyan, magenta and yellow dyes, relative to the recording medium, comprising: programcode for controlling the ink jet head such that recording is performed using the color inks discharge portion alone without using the black ink discharge portion, when any of a monochromatic image and a color image of a plurality of colors is recorded onto the recording medium, and when the recording medium has a substrate and an ink receiving layer provided onto a side of the substrate, the recording medium is to be viewed from a side opposite to the substrate to the surface having the ink receiving layer.

The control method of the ink-jet recording apparatus of the fifteenth aspect of the invention is characterized by the following configuration.

The method of controlling an ink jet recording apparatus for recording an image onto a recording medium by scanning an ink jet head having discharge portions discharging a black ink including a black pigment and color inks including at least cyan, magenta and yellow dyes, relative to the recording medium comprises the steps of: providing a light-transmissive recording medium having an ink receiving layer; and controlling the ink jet recording apparatus such that recording a black region of a maximum density onto the recording medium is performed using the black ink with the color inks, wherein an area of from 30 to 70% of the maximum density black region is formed with the black ink and a rest areas of the maximum density black region is formed with the cyan, magenta and yellow dyes.

The control method of the ink-jet recording apparatus of the sixteenth aspect of the invention is characterized by the following configuration.

The method of controlling an ink jet recording apparatus for recording an image onto a recording medium by scanning an ink jet head having discharge portions discharging a black ink including a black pigment and color inks including at least cyan, magenta and yellow dyes, relative to the recording medium, comprises the steps of: providing a light-transmissive recording medium having an ink receiving layer; and controlling the ink jet recording apparatus such that recording a black region onto the recording medium is performed using the black ink with the color inks.

The machine-readable storing medium of the seventeenth aspect of the invention is characterized by the following configuration.

The machine-readable storing medium is for storing programcode for executing reading control processing of an ink jet, recording system for recording an image onto a recording medium by scanning an ink jet head having discharge portions discharging a black ink including a black pigment and color inks including at least cyan, magenta and yellow dyes, relative to the recording medium, comprising: programcode for controlling the ink jet head such that recording a black region of a maximum density onto a light-transmissive recording medium having an ink receiving layer is performed using the black ink with the color inks, wherein an area of from 30 to 70% of the maximum density black region is formed with the black ink and a rest area of the maximum density black region is formed with the cyan, magenta and yellow dyes.

The machine-readable storing medium of the eighteenth aspect of the invention is characterized by the following configuration.

The machine-readable storing medium is for storing programcode for executing reading control processing of an ink jet recording system for recording an image onto a recording medium by scanning an ink jet head having discharge portions discharging a black ink including a black pigment and color inks including at least cyan, magenta and yellow dyes, relative to the recording medium comprising: programcode for controlling the ink jet head such that recording a black region onto a light-transmissive recording medium having an ink receiving layer is performed using the black ink with the color inks.

The control method of the ink-jet recording apparatus of the nineteenth aspect of the invention is characterized by the following configuration.

The method of controlling an ink jet recording apparatus for recording an image onto a postcard by scanning an ink jet head having discharge portions discharging a black ink including a black pigment and color inks including at least cyan, magenta and yellow dyes, relative to the postcard, comprises the steps of: providing a postcard; and controlling the ink jet recording apparatus such that recording a black region of a color image onto the postcard is performed using the black ink with the color inks, wherein an area of from at least 40 to less than 90% of the black region is formed with the black ink and a rest areas of the black region is formed with the cyan, magenta and yellow dyes.

The machine-readable storing medium of the twentieth aspect of the invention is characterized by the following configuration.

The machine-readable storing medium is for storing programcode for executing reading control processing of an ink jet recording system for recording an image onto a recording medium by scanning an ink jet head having discharge portions discharging a black ink including a black pigment and color inks including at least cyan, magenta and yellow dyes, relative to the recording medium, comprising: programcode for controlling the ink jet head such that recording a black region of a color image onto the postcard is performed using the black ink with the color inks, wherein an area of from at least 40 to less than 90% of the black region is formed with the black ink and a rest area of the black region is formed with the cyan, magenta and yellow dyes.

The control method of the ink-jet recording apparatus of the twenty-first aspect of the invention is characterized by the following configuration.

The method of controlling an ink jet recording apparatus for recording an image onto a recording medium by scanning an ink jet head having discharge portions discharging a black ink including a black pigment and color inks including at least cyan, magenta and yellow dyes, relative to the recording medium, comprises the steps of: providing the recording medium having an ink receiving layer provided onto an opaque substrate; and controlling the ink jet recording apparatus such that recording onto the recording medium is performed using the black ink alone without using the color inks when a monochromatic image is recorded onto the recording medium, recording onto the recording medium is performed using the color inks alone without using the black ink when a color image of a plurality of colors is recorded onto the recording medium.

The machine-readable storing medium of the twenty-second aspect of the invention is characterized by the following configuration.

The machine-readable storing medium is for storing programcode for executing reading control processing of an ink jet recording system for recording an image onto a recording medium by scanning an ink jet head having discharge portions discharging a black ink including a black pigment and color inks including at least cyan, magenta and yellow dyes, relative to the recording medium, comprising: programcode for controlling the ink jet head such that recording onto the recording medium is performed using the black ink alone without using the color inks when a monochromatic image is recorded onto the recording medium, recording onto the recording medium is performed using the color inks alone without using the black ink when a color image of a plurality of colors is recorded onto the recording medium.

BRIEF DESCRIPTION OF THE DRAWINGS

FIG. 3 illustrates with what ink recording is to be carried out in response to the kind of the medium to be recorded in the invention;

DESCRIPTION OF THE PREFERRED EMBODIMENTS

Embodiments of the present invention will now be described in detail with reference to the drawings.

Figure 1:
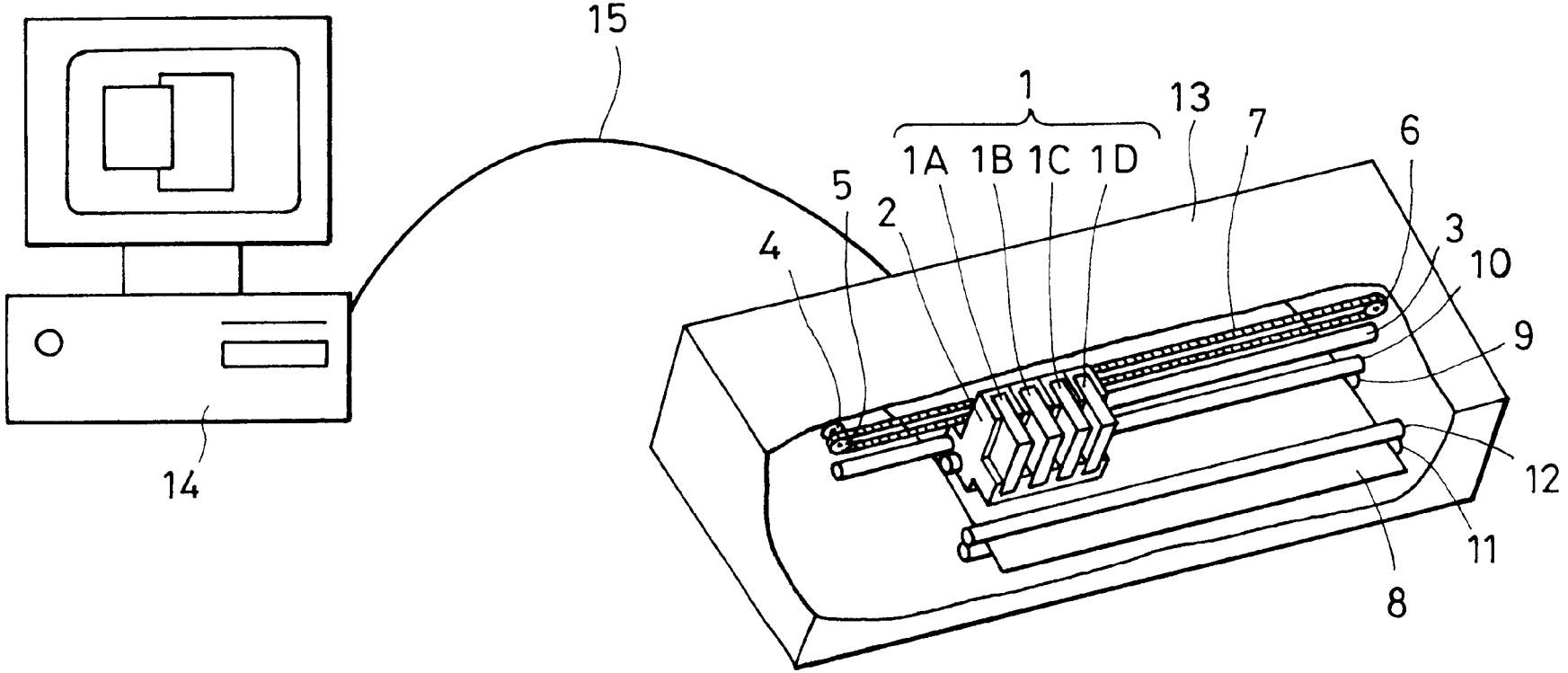
FIG. 1 is a perspective view illustrating an embodiment of the ink-jet recording apparatus to which the present invention is applied.

FIG. 1 illustrates an embodiment of the ink-jet recording apparatus to which the invention is applied. In FIG. 1, a plurality (four) head cartridges (recording means) 1A, 1B, 1C and 1D are exchangeably loaded onto a carriage 2 in an ink-jet printer 13. The plurality of recording means 1A to 1D as a whole or any of them will hereinafter be referred to simply as "recording means" (recording head or head cartridge) 1.

Each head cartridge 1 has an ink tank section in the upper part thereof and a recording head section (ink discharge section) in the lower part thereof, forming an integrated structure with the recording head and the ink tank. Each recording means 1 is positioned on, and exchangeably loaded on the carriage 2, and provided with a connector (not shown) for receiving a signal for driving the recording head section or the like. The carriage 2 is, on the other hand, provided with a connector holder (electric connection section) for communicating a driving signal or the like to each recording means 1 via the connector. The recording means 1 on the carriage 2 are connected to a control circuit on the apparatus main body side with flexible cables for feeding signal pulse current or temperature conditioning current.

Blank (K) pigment ink, cyan (C) dye ink, magenta (M) dye ink and yellow (Y) dye ink are contained in 1A, 1B, 1C and 1D, respectively, of the ink tank section in the upper part of each head cartridge, and a plurality of discharge ports are arranged in a line at prescribed intervals (for example, about 71 $\mu$m in the case of 360 dpi) in accordance with a prescribed resolution (for example, 360 dpi; dpi is the number of dots per inch) for discharge the ink on the surface opposite to a recording medium 8 of each recording head section. Each of the discharge ports discharges respective ink contained. The number of discharge ports for K is larger than that for the other three colors CMY. When recording a monochromatic image such as a black character or a black line usually employed in many uses, recording can be carried out at a high speed by using only the discharge ports for K. The three colors cyan, magenta and yellow will hereinafter be referred to as CMY, and these colors and black, as CMYK.

The carriage 2 is guided and supported reciprocally along a guide shaft 3 provided on the apparatus main body, extending in the main scanning direction. The carriage 2 is driven by a main scanning motor 4 via a motor pulley 5, a following pulley 6 and a timing belt 7, for control of the position and displacement thereof. A recording medium 8 such as paper or a plastic thin sheet is held between two sets of transfer rollers 9, 10 and 11, 12, and transported (sheet feeding) through a position (recording section) opposite to the discharge port plane of the recording head 1 under the effect of rotation of these transfer rollers. The back of the recording medium 8 is supported by a platen (not shown so as to form a flat recording surface in the recording section. In this case, the head cartridges 1 loaded on the carriage 2 are held so as to have the discharge port planes projecting downward from the carriage 2 and to be in parallel with the recording medium 8 between the two sets of transfer rollers.

The ink-jet printer 13 integrally formed by the aforementioned components is connected to a personal computer 14 via a cable 15, and controlled by driver software installed in the personal computer 14.

Figure 2:
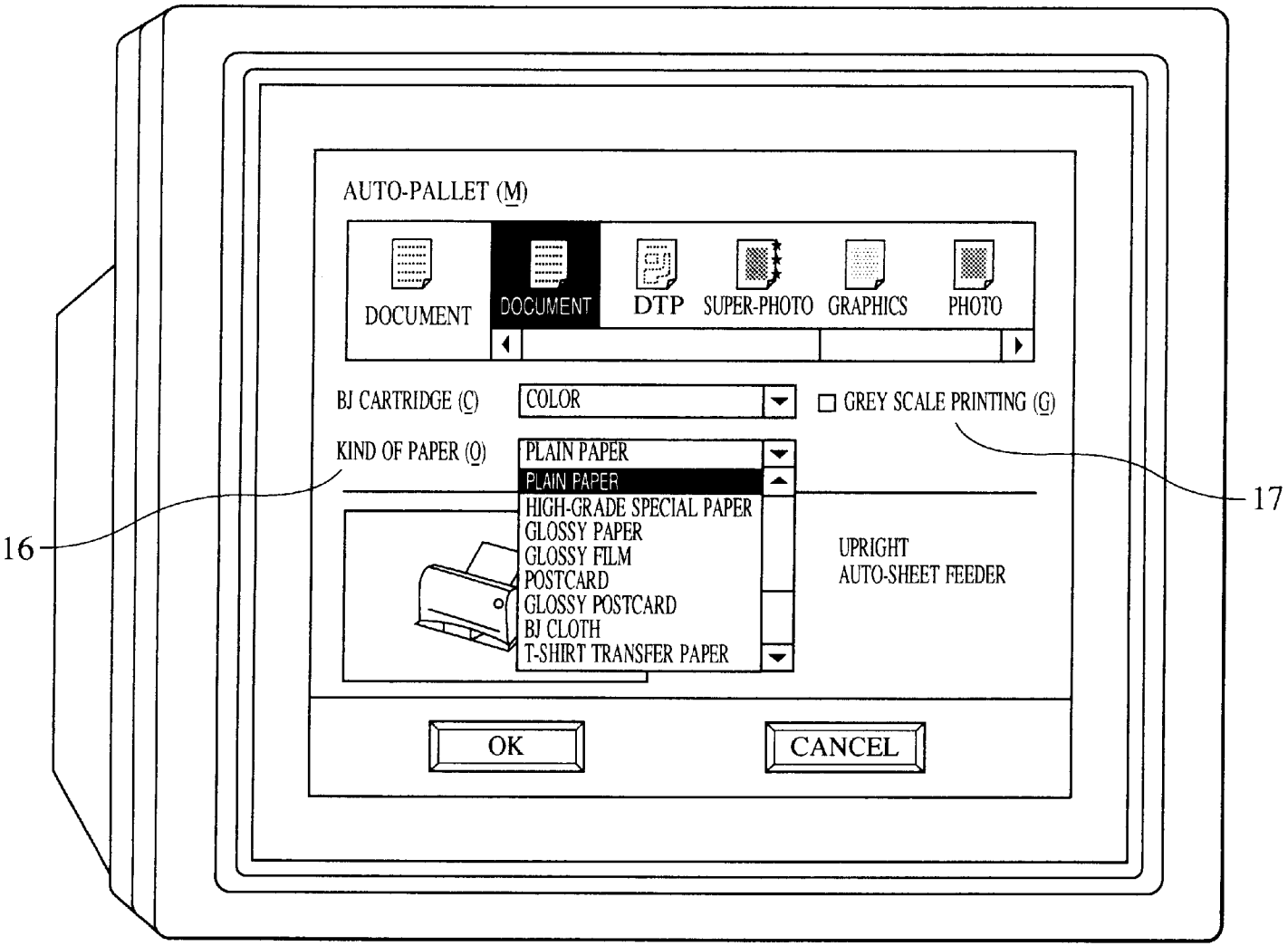
FIG. 2 illustrates screen setting properties of an ink-jet printer at a user interface of driver software of the invention.

FIG. 2 illustrates a typical setting screen of properties of the ink-jet printer 13 on the user interface of the above-mentioned driver software. By specifying a recording medium onto which recording is to be made by the ink-jet printer 13 on a pulldown menu displayed as 16 "Type of sheet", image data of R (red), G (green) and B (blue) to be recorded are converted into CMYK recording data optimum for the type of each recording medium. When checking a check box of 17 "Grey Scale Printing", RGB values of the image data for recording are converted into monochromatic data on the basis of a calculation such as, for example, X=2*R+2*G+B/5, and recording data which would be recorded by the ink-jet printer 13 with image data of a single color phase of grey as viewed visually are transmitted via the cable 15. In the present specification, the color mode means is used to select a mode for recording a color image of a plurality of colors, and the grey scale mode means is used to select a mode for recording a monochromatic image. When RGB signal values are expressed with eight bits, respectively, in general, input image data R=G=B=255 correspond to recording of perfect white, and R=G=B=0, to recording of perfect black. In this specification, a recorded maximum density black (solid black) means black recorded when RGB values of input image data are R=G=B=0: when the input image data for a pixel are equal to R=G=B=0, that pixel is recorded with a maximum density black.

FIG. 3 illustrates with what ink recording is to be carried out in response to the kind of the recording medium. The reason of the relationship shown in FIG. 3 will be described.

When the set recording medium is a glossy one (glossy paper or a glossy film) and recording is to be accomplished in the color mode, recording should be made with the ink of three colors CMY. That is, a black portion would be formed by placing CMY one over another, i.e., with composite black. If the pigment black ink and the dye color ink are simultaneously recorded, the portion onto which the pigment ink is injected would become a non-glossy portion, as described above, where dots of non-glossy portion are locally produced, resulting in a very strange image, and this is not desirable at all in terms of photo quality. More specifically, the pigment cannot penetrate deep into the medium because of the large particle size, and remains on the medium surface to cover the glossy portion of the medium surface. Only the surface portions having residual pigment lose glossy. On the other hand, the dye penetrates deep into the medium because of the small particle size, and therefore, the effect on the medium surface is far slither than the pigment.

In the grey scale mode, recording is accomplished with black (pigment ink) alone. When the user selects positively grey scale mode, black characters or black lines are recorded more often than recording a color image which as converted into a grey scale image. In such a case, the black portions do not account for a large area, and since this is not a photo image, loss of glossy as a result of recording of the black pigment ink, if any, does not pose a serious problem in image quality. Black recorded with composite black has generally a lower density than black recorded with pigment black ink. With an insufficient positional adjustment between different colors of the head, the color comes off the black characters or the black lines. When recording characters or fine lines of a small font, and the image to be recorded is not in the maximum density black (the maximum density black means 100% black, i.e., RGB values of the input image data are R=G=B=0), a defect tends to occur in which characters or lines are colored. In the grey scale mode, therefore, the image should preferably be recorded with pigment black ink alone, as described above.

Even for a non-glossy medium having an ink receiving layer provided on the substrate, such as special ink-jet paper, as in the case of the above-mentioned glossy medium, recording is accomplished with the three colors CMY, if in the color mode, and with the pigment black ink alone, if in the grey scale mode. The reason is as follows. This non-glossy medium as well has an ink receiving layer, and only the pigment remains on the medium surface, as in the case described above. Although not to the extent as that for the above-mentioned glossy medium, therefore, the residual pigment affects the image quality. More specifically, in the non-glossy medium, the surface irregularities are smoothed by the ink receiving layer. When recording is carried out on this smoothed surface by the simultaneous use of the pigment black ink and the dye color ink, only the pigment remains on the medium surface. Only the pigment particles become conspicuous, and this is not desirable as an image. The dye penetrates in contrast deep into the medium, so that the dye particles never become conspicuous. This phenomenon is considered to be remarkable particularly when surface irregularities are smoothed. For a recording medium not provided with an ink receiving layer on the surface thereof such as plain paper, the surface is not smoothed and has larger surface irregularities as compared with the aforementioned non-glossy medium or the glossy medium. Even upon injection of the pigment, coarseness of the pigment particles is not so visible because the surface itself is rough. Upon injection of pigment particles having a large particle size onto the medium surface with smaller surface irregularities, coarseness of the pigment particles is conspicuous because the particle size is larger than the surface irregularities. While cellulose itself of plain paper has a size of from 1 to several tens of $\mu$m, silica or alumina composing the ink receiving layer of the glossy medium or the non-glossy medium has a particle size of from 0.01 to 0.1 $\mu$m. Pigment has a particle size of about 1 $\mu$m in an aggregated state. This suggests that the pigment particles larger than the particle composing the surface makes coarseness of particles more conspicuous, and pigment particles cannot penetrate into the ink receiving layer.

In the grey scale mode, recording should preferably be conducted with pigment black ink alone. For the same reason as that in the case of the glossy medium described above.

The substrate composing the above-mentioned glossy medium and the non-glossy medium is an opaque substrate such as paper or a film.

When image data comprise a single color phase of grey as typically represented by R=G=B, the mode may be switched over to the grey scale mode even if the user selects the grey scale mode.

The following paragraphs describe the case where the recording medium has an ink receiving layer provided on a side of a substrate such as a back-printed film or a T-shirt transfer medium, and the recorded image is to be viewed from a side opposite to the surface having the ink receiving layer. When using a recording medium to be viewed from a side opposite the recorded surface, the pigment ink hardly penetrates to reach the side opposite to the recorded surface and a sufficient print density is unavailable. This is why dye ink easily penetrating into the ink receiving layer is employed. Recording is therefore carried out with the three colors CMY both in the color mode and in the grey scale mode.

The case where the recording medium is light-transmissive and has an ink receiving layer will now be described. While a plastic sheet is used as an example of the light-transmissive recording medium, it is not limited to this.

Figure 7A:
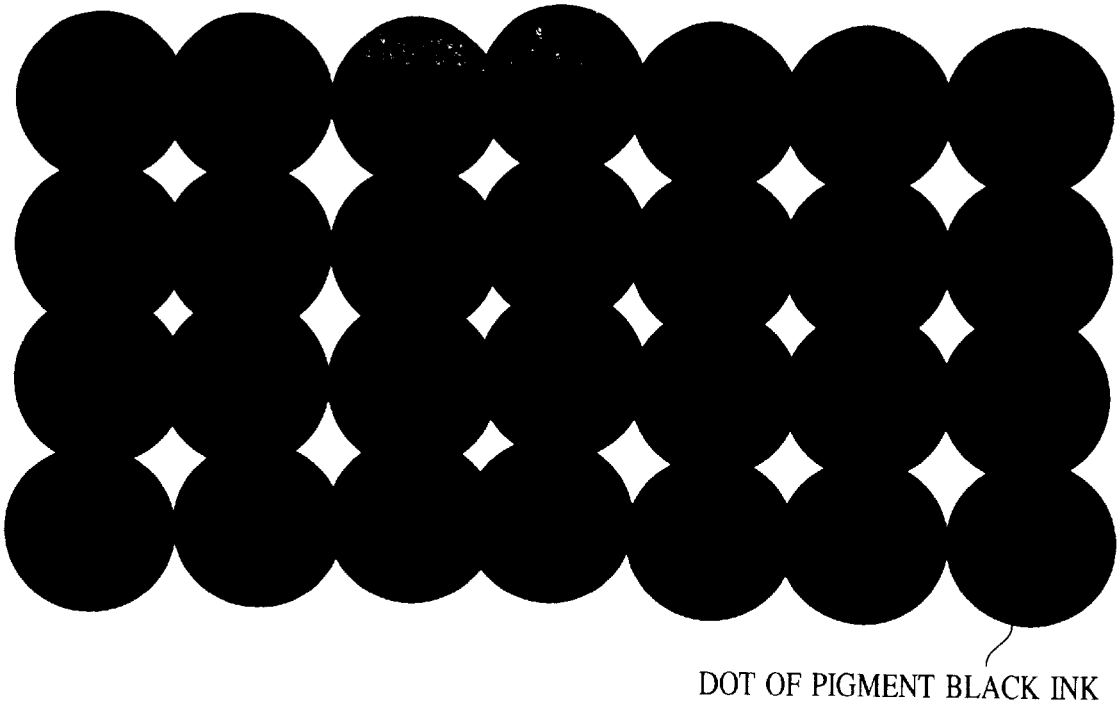
FIG. 7A illustrates a black region formed when conducting recording with pigment black ink alone.
Figure 7B:
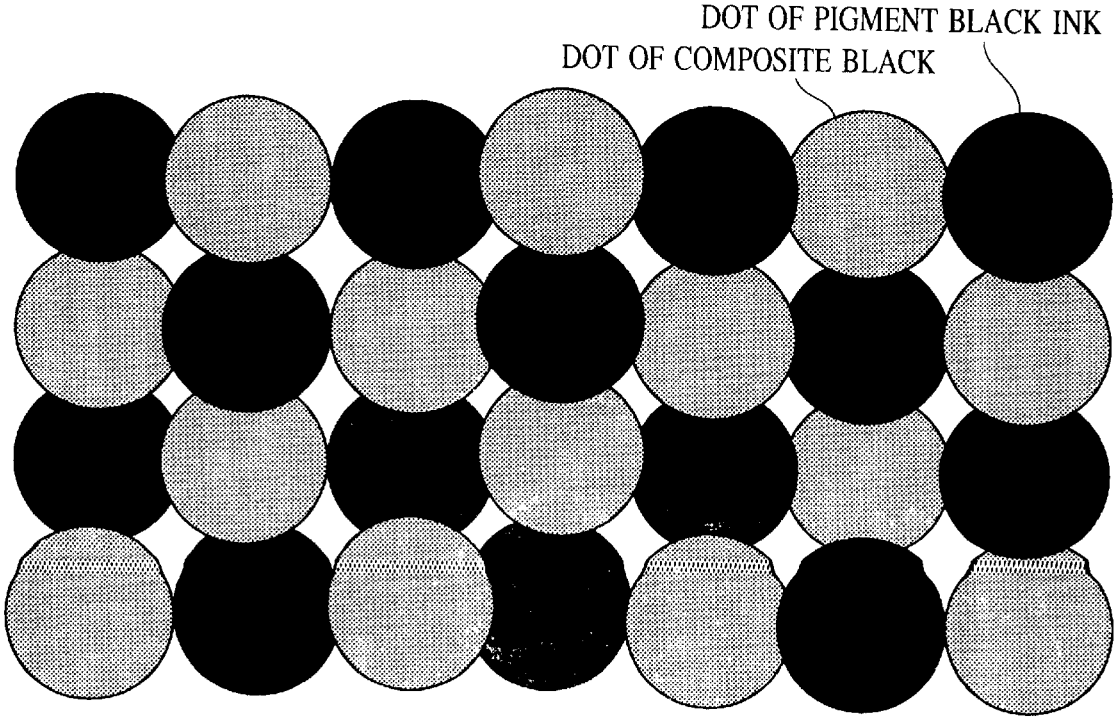
FIG. 7B illustrates a black region formed by the simultaneous use of pigment black ink and dye color ink, in an embodiment of the invention.

When the recording medium is a plastic sheet having an ink receiving layer, recording is accomplished with the four colors CMYK in the color mode as well as in the grey scale mode. When recording a black region, recording is conducted by discharging the pigment black ink and the dye color ink at a prescribed ratio onto the recording medium. That is, a mixture of black based on the pigment ink and black of composite black forms the black region (FIG. 7B). Forming the black region by discharging the pigment black ink and the dye color ink at the prescribed ratio onto the recording medium leads to a higher density of the black portions, providing an effect of increasing density as compared with recording with the pigment black ink alone. Formation of the black region by the simultaneous use of the pigment black ink and the dye color ink permits reduction of the amount of the pigment black ink, thus making it difficult for cracking to occur. FIG. 7B illustrates formation of the black region by the simultaneous use of the pigment black ink and the dye color ink; and FIG. 7A illustrates formation of the black region when recording was effected with the use of the pigment black ink.

The result of an experiment carried out on the degree of cracking relative to the amount of injected pigment black ink is shown in Table 1. As is evident from Table 1, no problem of cracking is posed with an amount of injected pigment black ink of up to 80%. The term the amount of injected ink will be defined later.

TABLE 1

| AMOUNT OF INJECTED PIGMENT BLACK INK (%) | STATUS OF CRACKS |
|---|---|
| 50 | Excellent |
| 60 | Excellent |
| 70 | Excellent |
| 80 | Excellent |
| 90 | Good |
| 100 | Poor |

Figure 4:
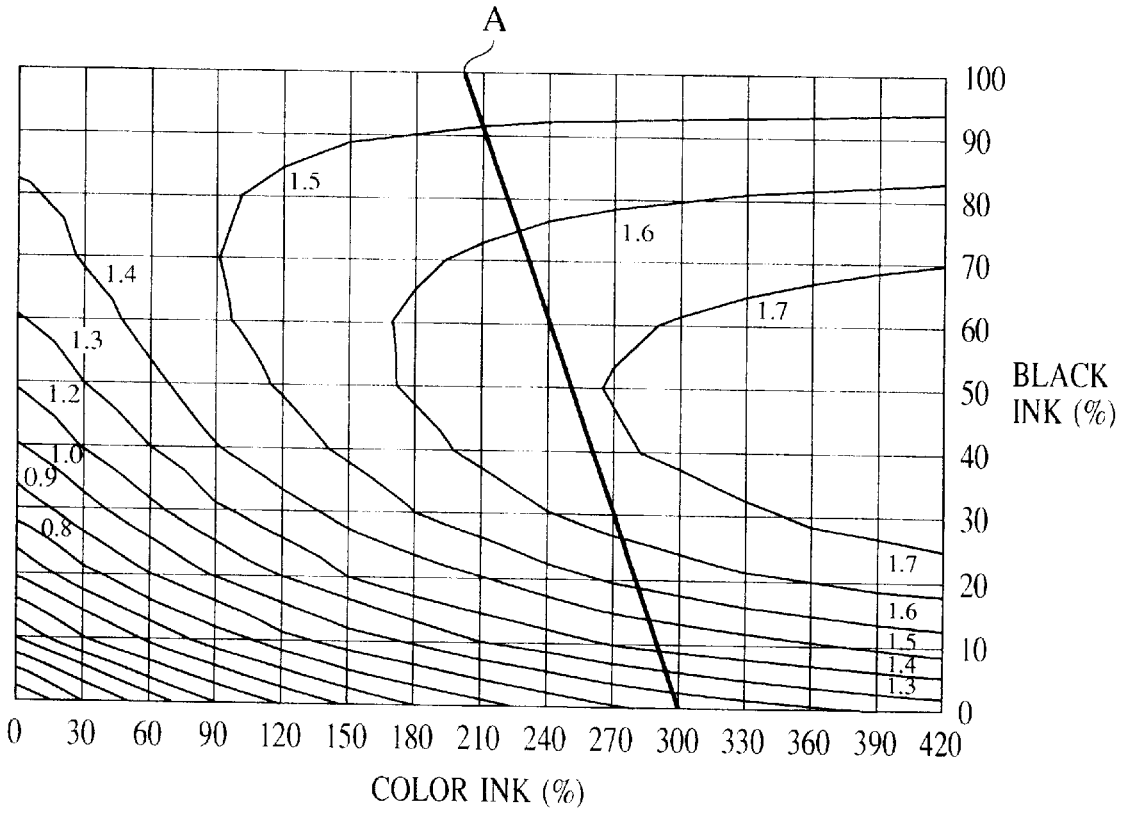
FIG. 4 illustrates contour lines of black density in the case where a black region is formed by a mixture of pigment black ink and dye color ink on a plastic sheet provided with an ink receiving layer in an embodiment of the invention.

FIG. 4 illustrates contour lines representing values of black density in a case where a black region is formed by discharging the pigment black ink and the dye color ink onto a plastic sheet having an ink receiving layer. The abscissa represents the amount of injected color ink of the three colors in total, and the ordinate, the amount of injected black ink. In this specification, the amount of injection (%) is defined as follows. The "amount of 100% injection" is defined, in a case where each ink (C, M, Y, K) is injected onto a prescribed unit area (one pixel) of plain paper, as a minimum amount necessary for fully covering this prescribed unit area (one pixel) by each ink. Therefore, an amount of injection x represents a ratio to the above-mentioned amount of 100% injection. On the assumption that the amount of ink for the amount of 100% injection is 1, the amount of ink required for an amount of injection of 80% is substantially 0.8. When the ink injected in an amount of injection of 80%, i.e., an amount of ink of 0.8 onto one pixel, an area of substantially 80% in the pixel is covered by the ink. Taking this into account, the "amount of injection (%)" may be referred to as the "ratio of the area covered by each ink relative to a prescribed area of one pixel". For example, the amount of injected pigment black ink of 70% in Table 1 means that, with the amount of pigment black ink injected relative to the amount of 100% injection as a reference value, an amount of ink of substantially 70% of the reference value is injected onto a pixel, and in other words, the ratio of the area covered by the pigment black ink in the prescribed area of one pixel is 70%. The ink receiving layer has generally a large allowable amount of injected ink that for plain paper. Overflow does not therefore occur even when the amount of 100% injection is largely exceeded. More specifically, the upper limit of the amount of injected ink onto the ink receiving layer is substantially 300%. That is, it is possible to inject an amount of ink substantially three times as large as the minimum amount of ink necessary for covering one pixel in plain paper.

In the invention, the density means an optical density. The density can be measured by means, for example, a densitometer Model 404A (made by X-Pite Co.).

Figure 5:
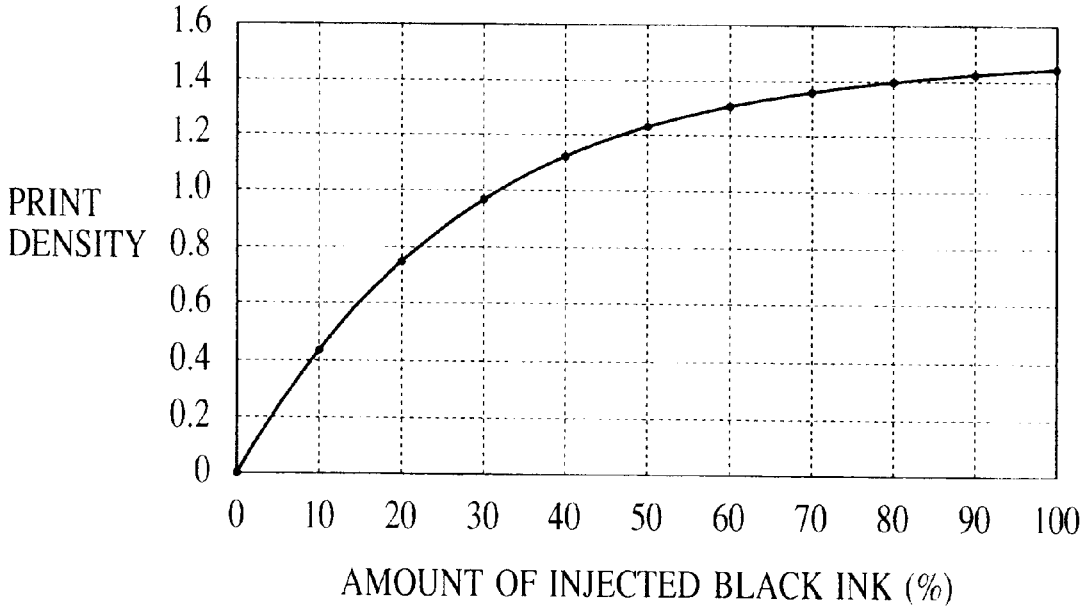
FIG. 5 illustrates the black density where injecting pigment black ink alone on a plastic sheet provided with an ink receiving layer in an embodiment of the invention.
Figure 6:
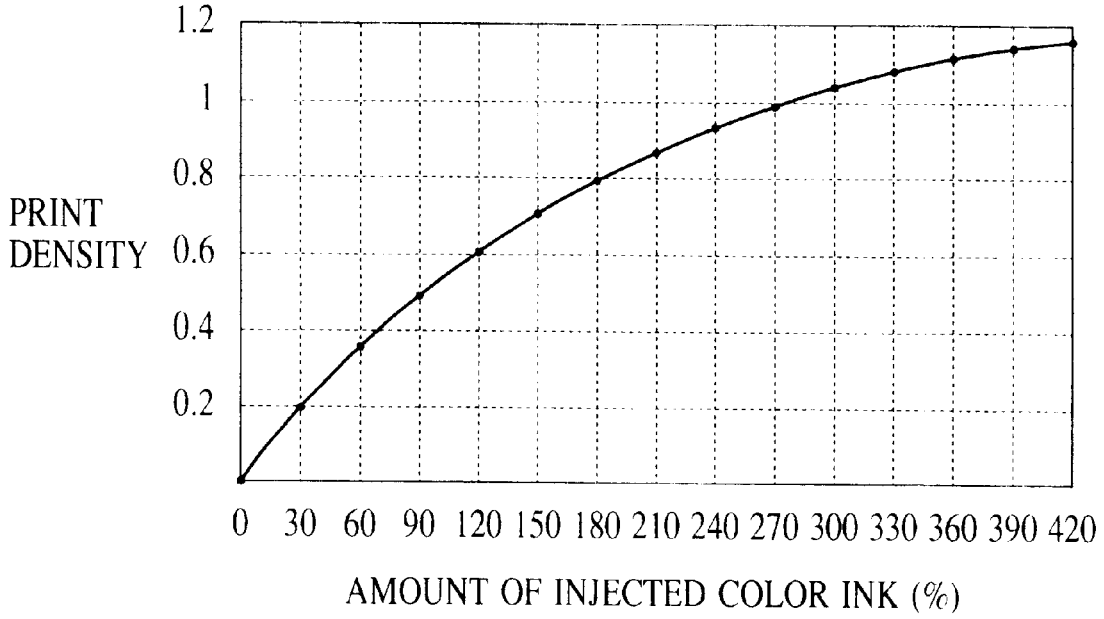
FIG. 6 illustrates the black density brought about by a composite black formed by dye ink injected onto a plastic provided with an ink receiving layer in an embodiment of the invention.

FIG. 5 illustrates the black density in a case where the pigment black ink is injected onto a plastic sheet having an ink receiving layer; and FIG. 6 illustrates the black density brought about by composite black formed by dye color ink injected onto a plastic sheet having an ink receiving layer: the both have positive properties. This is a general behavior of an ink-jet printer. The amount of injected color ink represented on the abscissa in FIG. 6 is the total amount of injection of color ink for CMYK.

The aforementioned density increasing effect can be known from these FIGS. 4, 5 and 6.

First, as is clear from FIG. 5, recording with the pigment black ink alone leads to a maximum value of black density of substantially 1.4. As is known from FIG. 4, a maximum density is available with amount of injected pigment black ink of about 50% and an amount of injected dye color ink of about 250% near a line where the total amount of injected pigment black ink and dye color ink reaches 300% which is the general upper limit of injected ink on a plastic sheet having an ink receiving layer (A in FIG. 4). This density value is equal substantially to 1.7.

These considerations suggest that forming a black region by discharging the pigment black ink and the dye color ink at a prescribed ratio onto the recording medium is more effective for achieving a higher density of the black portion, resulting in a more remarkable density increasing effect, than recording with the pigment black ink alone.

The reason why the density curve takes the form shown in FIG. 4 is as follows.

The black density available when forming a black region through simultaneous use of the pigment black ink and the dye color ink is expressed by the following formula:

[Black density]=[Black density corresponding to the amount of injected black ink]+[Value of ratio of the area to which the black ink is not injected (gap of black ink)]×[Black density by composite black corresponding to the amount of injected color ink]

For example, assume an amount of injected black ink of 50% and an amount of injected color ink of 80%. Because the amount of injected black ink is 50%, it is known from FIG. 5 that the black density is substantially 1.2. The value of ratio of the area to which the black ink is not injected is 0.5. Because the black ink is injected onto 50% per unit area, the area to which the black ink is not injected is equal to the remaining 50%. Finally, since the amount of injected color ink is 180%, the black density achieved by composite black corresponding to the amount of injected color ink is known from FIG. 6 to be 0.8. Incorporation of these values into the above-mentioned formula would lead to

[Black density]=[1.2]+[0.5]×[0.8]=[1.6].

This density value 1.6 substantially agrees with the density value shown in FIG. 4.

Because the black density when forming the black region by the simultaneous use of the pigment black ink and the dye color ink is expressed by the aforementioned formula as described above, the density curve takes the form as shown in FIG. 4.

It is thus suggested that, because gaps are produced between dots of the pigment black ink according as the amount of injected pigment black ink is reduced from 100%, injection of the color ink has a density increasing effect. When the input image data satisfy R=G=B=0 and the maximum density black (solid black) is recorded, the amount of injected pigment black ink should preferably be within a range of from 30 to 70%, or more preferably, from 40 to 60%, or most preferably, substantially 50%. With an amount of over 70%, cracking may occur, and with an amount of under 30%, the black density becomes too low. For recording solid black, therefore, the amount should preferably be from 30 to 70%.

At portions with a density of the pigment black ink of 100%, the black ink fully covers the surface of the ink receiving layer, and the color dye ink, to whatever extent it is injected, is absorbed by the ink receiving layer and does not appear on the surface, thus leading to no change in the density. With an amount of injected pigment black ink of 100%, further injection of the dye color ink does not give a density increasing effect.

The case of recording on an OHP sheet serving as a plastic sheet will now be described with reference to the above result. The OHP sheet used in this embodiment have ink receiving layers on the base (substrate) of a transparent plastic sheet to avoid wrong determination of surface/back. The OHP sheet absorbs the ink through swelling of the ink receiving layer provided on the surface of the OHP sheet.

When conducting recording on the OHP sheet as described above, the type of sheet "OHP sheet", recording grade and other recording conditions are first specified on a user interface by the driver software. The driver software converts the image data into CMYK dot data and transmits the result in compliance with the specified conditions.

Figure 8:
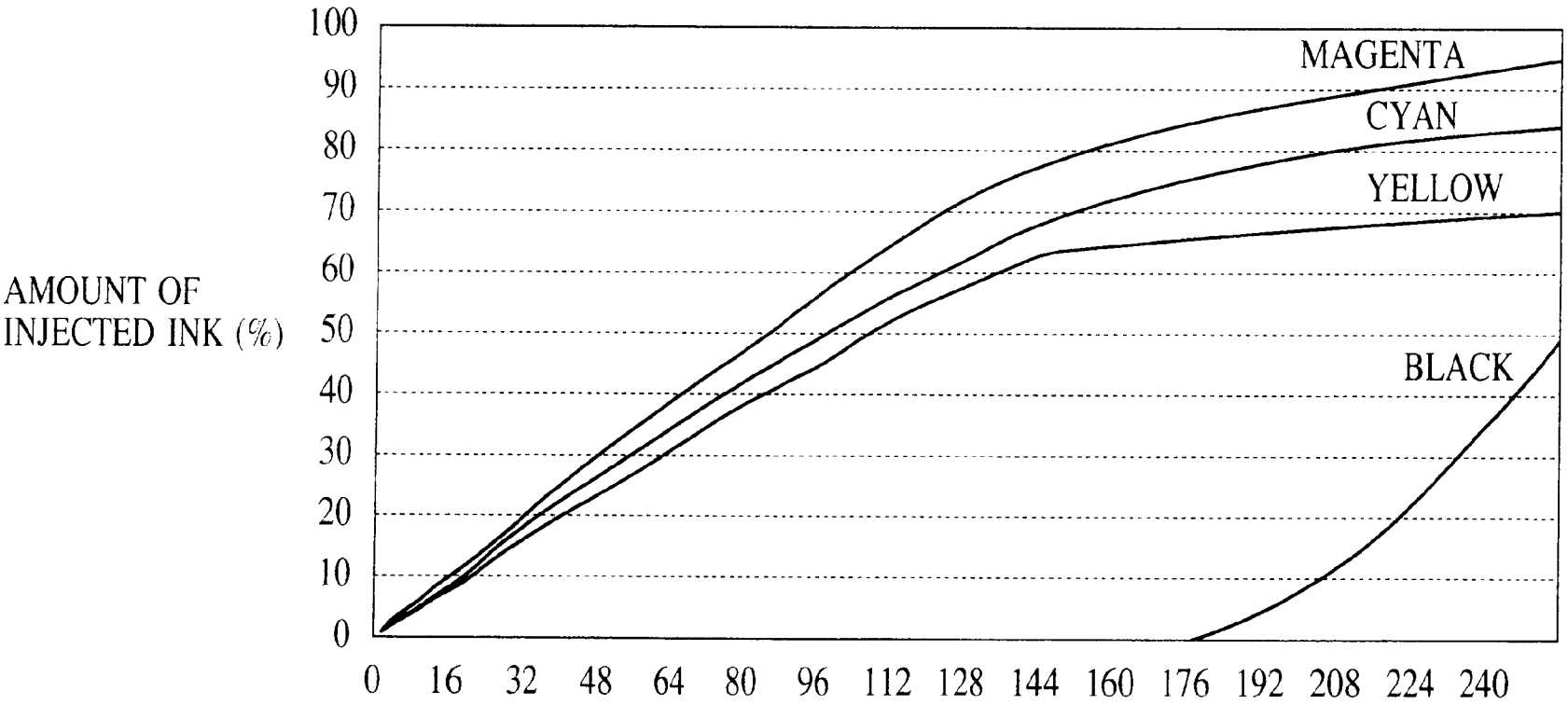
FIG. 8 illustrates the amount of injected ink onto an OHP sheet in an embodiment of the invention.

FIG. 8 illustrates the amount of injected ink for CMYK dot data converted from grey scale data of 256 gradations (0 to 225) expressing the driver software in 8 bits (0 indicates perfect white, and 225, perfect black, i.e., the maximum recording density black) in the present embodiment. FIG. 8 shows the amount of injected ink for the OHP sheet, where the term 100% has the same definition as above.

In FIG. 8, at the maximum recorded black (solid black) i.e., at a grey scale level 225, the amounts of injected ink comprise about 50% black ink, about 84% cyan ink, about 95% magenta ink, and about 71% yellow ink. (The total CMY of 250%; the ratios of the three colors, depending upon the dye density of the ink and coloring property, are not always constant.) The amount 50% of black is an amount of injected ink on a level on which no cracking occur when conducting recording on an OHP sheet with the pigment ink alone.

To achieve a beautiful gradation of the image, it is desirable to cause the dot ratio for the middle portion of the grey scale to continuously change toward the dot ratio of the maximum recorded density black (solid black) as shown in FIG. 8. In other words, the amount of injected pigment black ink is gradually increased according as the grey scale level becomes higher. In FIG. 8, for example, when recording a black region having a grey scale level of 208, the amount of injected pigment black ink is about 10%, and when recording a black region of a grey scale level of 224, the amount of injected pigment black ink is about 25%. With a grey scale level of under 176, recording is accomplished without the use of the pigment black ink. The amount of injected pigment black ink is not limited to those shown in FIG. 8, but any amount is applicable as far as it permits formation of a smooth gradation. More specifically, the maximum amount of injected pigment black ink is 50% in FIG. 8, but it is not limited to this. Any maximum amount of up to 80% is applicable since cracking does not occur with such an amount. While the black region is formed without the use of the pigment black ink at a low grey scale level in FIG. 8, the pigment black ink may be used even at a low grey scale level.

In this embodiment, the driver software generates CMYK dot ratios as shown in FIG. 8. CMYK dot data may however be generated, as another embodiment of the invention, in accordance with the above dot ratios by a printer firmware on the basis of a K dot data transferred from the driver. The simultaneous injection of the pigment black ink and the dye color ink increases the print density as described above. This is therefore effective particularly for an OHP sheet requiring a high density. While the case of recording on an OHP sheet has been described in the aforementioned embodiment, the invention is of course applicable also to any other plastic sheet.

The case where the recording medium is a postcard will be described. When the recording medium is a postcard, recording in the color mode is accomplished with four colors CMYK. As in the above-mentioned case of the OHP sheet, when recording a black region, recording is conducted by discharging the pigment black ink and the dye color ink at prescribed ratios onto the medium. As a counter-measure against the problem upon using an auto-sheet feeder for printing on a postcard as described above, the pigment ink is prevented from adhering to the next sheet by reducing the amount of injected pigment black ink. Reduction of the amount of injected pigment black ink inevitably leads to a lower print density. To compensate such a decrease in density, therefore, a composite black of color dyes is used simultaneously with the pigment black ink. When forming a black region on a postcard, an area of from at least 40% to under 90%, or more preferably, from at least 50% to under 70% of the black region area should preferably be formed with the pigment black ink. The reason is that, as is clear from the following Table 2, an area of under 40% results in a defect of a low print density not allowable even by over-injecting the color ink. An area of over 90% leads to a lower frictional wear resistance of the pigment (with a poor fixing of the pigment and adherence to the next sheet).

In the grey scale mode, recording is performed with the pigment black ink alone. In this case, as in the above case of color mode, the amount of injected pigment black ink is reduced, but the dye color ink is never used simultaneously. In the grey scale mode of a postcard, many applications are considered to require printing of black characters of addresses and names, and it would be desirable to give priority to the printing speed over the problems of image quality or frictional wear resistance. In this case, as is known from Table 2, the ratio of the pigment black ink should preferably be substantially 80% from the balance between density and frictional wear resistance. When conducting recording with the pigment black ink alone, it is possible accomplish printing by using only the K discharge port without the use of the discharge port for the color ink, thus permitting high-speed printing.

In the above-mentioned embodiment, the grey scale mode has comprised recording with the pigment black ink alone. When the image quality is preferred to the speed, recording may be accomplished with four colors CMYK to improve the print density in the grey scale mode as in the color mode as described above. During all events, when conducting recording on the postcard, the image data should preferably be recorded by thinning out dots of the pigment black ink. Recording the image data thus thinned out permits avoidance of the defect of adherence of the pigment ink to the next sheet and providing the effect of leading to a higher printing speed. The Table 2 shown below gives acceptability of density and frictional wear resistance of the black region when performing recording on a postcard with the use of the pigment black ink and the dye color ink. The optimum amount of injected pigment black ink is known and reference is made to (3) and (4) in Table 2 when recording a black region in the color mode, and reference is made to (2) and (4) when recording a black region in the grey scale mode.

TABLE 2

| ①AMOUNT OF INJECTED PIGMENT BLACK INK (%) | ②DENSITY OF BLACK REGION WITH PIGMENT BLACK INK ALONE | ③DENSITY OF BLACK REGION WITH PIGMENT BLACK INK AND COMPOSITE | ④FRICTIONAL WEAR RESISTANCE |
|---|---|---|---|
| 30 | Poor | Poor | Excellent |
| 40 | Poor | Good | Excellent |
| 50 | Poor | Excellent | Excellent |
| 60 | Poor | Excellent | Excellent |
| 70 | Poor | Excellent | Good |
| 80 | Good | Excellent | Good |
| 90 | Excellent | Excellent | Poor |
| 100 | Excellent | Excellent | Poor |

Finally, when the recording medium is other than the above such as plain paper, recording is accomplished with four colors CMYK in the color mode. More specifically, when no ink receiving layer is provided on the substrate, and the recording medium is non-glossy, the recording medium has a rough surface because of the absence of an ink receiving layer, and recording of the pigment ink does not change absence of gloss on the surface since the recording medium is non-glossy. In such a case, a high-quality image with a satisfactory contrast is available rather by raising the maximum density by the use of the pigment black ink. In the grey scale mode, recording is carried out with the pigment black ink alone as in the case of the glossy medium. In the present specification, the plain paper is a sheet of paper not having an ink receiving layer, unlike the medium having an ink receiving layer provided on the substrate as in the above-mentioned OHP sheet. That is, the plain paper is a sheet of paper commonly used in offices.

Figure 9:
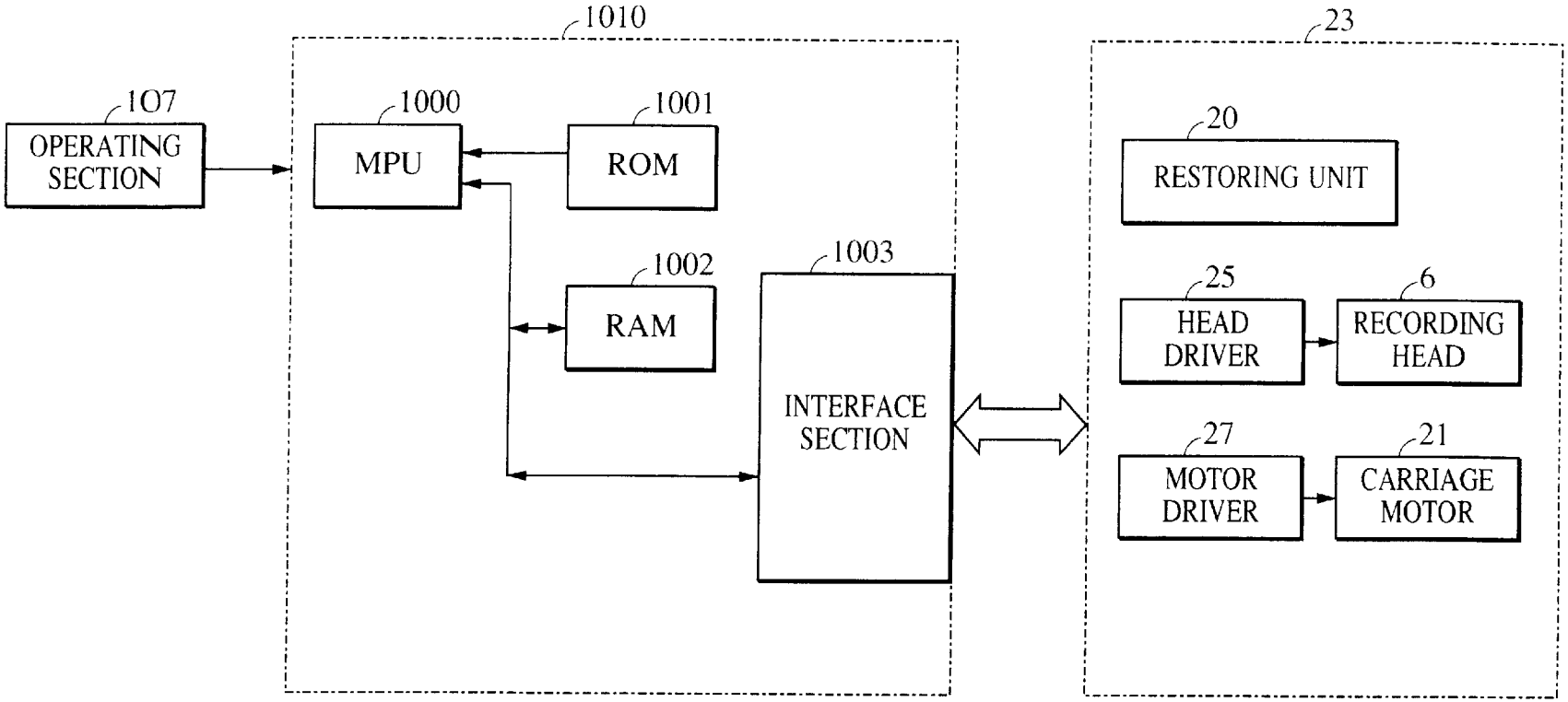
FIG. 9 is a block diagram illustrating a typical configuration of the control system of the ink-jet recording apparatus to which the present invention is applied.

FIG. 9 is a block diagram illustrating a typical configuration of the control system of the ink-jet recording apparatus having the above-mentioned configuration. In FIG. 9, 1010 represents a control section including control means controlling the kind and the amount of injection of the ink used in response to the recording medium, such as a personal computer; 1000, an MPU controlling the individual parts; 1001, an ROM storing the program corresponding to the control procedure thereof; and 1002, an RAM used as a work area upon executing the control procedure.

An operating section 107 and a printer 13 are connected to the control section 1010 via an interface section 1003. A control signal provided by the control section 1010 as an output drives a restoring unit 20, drives a recording head 1 via a head driver 25, and drives a carriage motor 21 via a motor driver 27. Apart from the above-mentioned personal computer, this control section 1010 may be built in the interior of the printer (in this case, the interface section 1003 is not necessary). The control section 1010 may also be incorporated in an input unit such as a digital camera so as to permit printing of an input image through connection with the printer.

Figure 10:
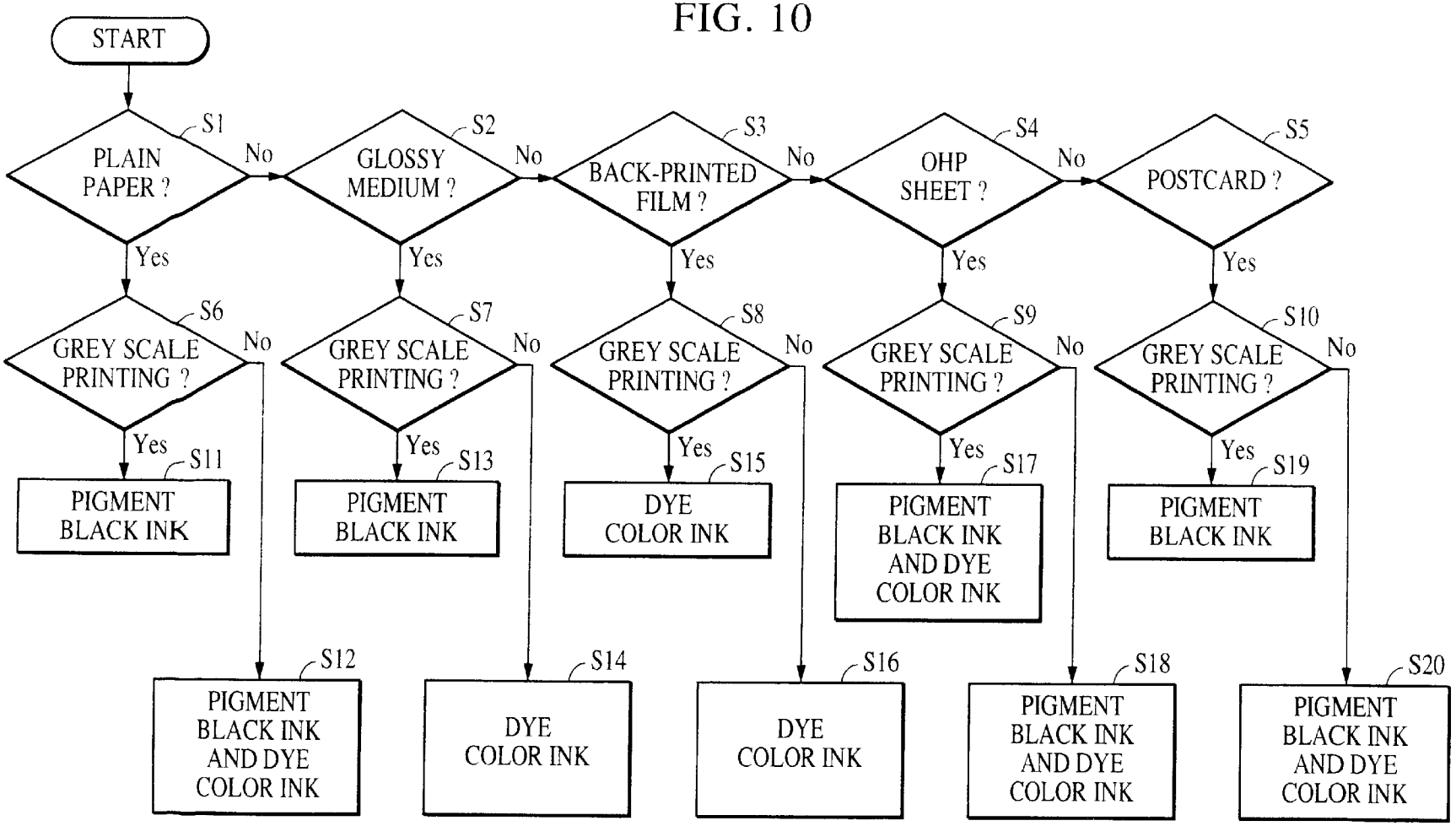
FIG. 10 is a flowchart illustrating control of selection of the kind of ink executed by the control section of the ink-jet recording apparatus to which the invention is applied.

FIG. 10 is a flowchart illustrating control for selection of a kind of ink, executed by the control section 1010 shown in FIG. 9, or more specifically, a flowchart illustrating which of the pigment black ink and the dye color ink is to be selected in response to the kind of the recording medium and the printing mode. For the purpose of controlling selection of ink upon recording pixels corresponding to image data, a signal showing the kind of the recording medium is determined, followed by determination of a signal of recording or not by grey scale printing. As a result of this determination, ink to be used is determined, and the printer receives an instruction to perform recording by the use of the determined ink.

When the kind of recording medium is determined to be plain paper in step S1, the process proceeds to step S6, and it is determined whether or not the signal is for grey scale printing. When the signal is for grey scale printing, the process advances to step S11 in which it is determined that recording is to be carried out by the use of the pigment black ink alone. If the signal is not for grey scale printing in step S6, the process goes to step S12, in which it is determined that recording should be accomplished by the simultaneous use of the pigment black ink and the dye color ink.

When the signal is not determined to be plain paper in step S1, the process proceeds to step S2. When the kind of recording medium is determined to be a glossy medium in step S2, the process goes forward to step S7, in which it is determined whether or not the signal is for grey scale printing. When the signal means grey scale printing, the process proceeds to step S13 to determine that recording should be made by the use of the pigment black ink alone. If the signal is not for grey scale printing in step S7, the process goes forward to step S12, and it is determined that recording should be done by the use of the dye color ink alone.

The subsequent steps, being the same as above, are omitted in the following description. When the signal means a back-printed film as a kind of recording medium, it is determined that recording should be made by the use of the dye color ink alone, irrespective of whether the signal is for grey scale printing or not.

If the signal specifying the kind of recording medium indicates an OHP sheet, it is determined that recording should be conducted by the simultaneous use of the pigment black ink and the dye color ink, irrespective of whether or not the signal is for grey scale printing.

When the signal specifies a postcard as the kind of recording medium, a signal meaning grey scale printing leads to determination specifying recording by the use of the pigment black ink alone, and a signal not meaning grey scale printing leads to determination that recording should be made by the simultaneous use of the pigment black ink and the dye color ink.

In the above-mentioned embodiment, the operator has entered the kind of recording medium from the operating section such as a printer driver. A sensor capable of automatically determining the kind of recording medium may be provided in the printer 13, and control of selection of a kind of ink as shown in FIG. 10 may be conducted on the basis of the result of determination. In this case, the kind of recording medium determined by the printer must be notified from the printer 13 to the control section 1010, so that the interface section 1003 must have a function of interactive communications. As a sensor based on optical detection such as that disclosed in Japanese Patent Laid-Open No. 5-23955 is considered effective as a sensor for automatic determination of the kind of recording medium.

Applicable types of ink suitable for the present invention will now be described.

The pigment black ink should preferably comprise at least a pigment-dispersed solution, a water-soluble organic solvent and water.

The pigment-dispersed solution is prepared by dispersing a pigment in a liquid medium by means of a polymer dispersant.

The pigment should preferably be carbon black, and applicable commercial products include No. 2300, No. 900, MCF. 88, No. 33, No. 40, No. 45, No. 52, MA7, MA8, No. 2200B (made by Mitsubishi Chemical Corp.), RAVEN1255 (made by Columbia Co.), REGAL400R, REGAL330R, REGAL660R, MOGUL L (made by Cabot Co.), Color Black FW1, Color Black FW18, Color Black S170, Color Black S150, Pintex 35, Pintex U (made by Tegussa Co.), and any pigment a manufactured anew.

A pigment composing the black ink selected from the above, together with a water-soluble resin (dispersant), is dispersed into an aqueous liquid medium. Applicable aqueous liquid media suitable in this case is a mixed solvent of water and a water-soluble organic solvent, and water should preferably ion-exchange water (deionized water), not ordinary water containing various ions. The content of water used should preferably be within a range of from 10 to 90 wt. %, or more preferably, from 30 to 80 wt. % relative to the total ink.

Applicable water-soluble organic solvents used in mixture with water include more specifically: alkyl alcohols having a carbon number of from 1 to 4 such as methyl alcohol, ethyl alcohol, n-propyl alcohol, isopropyl alcohol, n-butyl alcohol, sec-butyl alcohol, test-butyl alcohol; amides such as dimethylformaldehyde and dimethyacetoamide; ketones and ketoalcohols such as acetone and diacetoalkohol; ethers such as tetrahydrofuran and dioxane; polyalkyleneglycols such as polyethyleneglycol and polypropyleneglycol; alkyleneglycols formed by an alkylene group containing from 2 to 6 carbon atoms such as ethyleneglycol, propyleneglycol, butyleneglycol, triethyleneglycol, 1,2,6-hexanetrial, thiodiglycol, hexyleneglycol, and diethyleneglycol; glycerine; lower alkylethers of polyhydric alcohol such as ethyleneglycolmonomethyl (or ethyl) ether, diethyleneglycolmethyl (or ethyl) ether, and triethyleneglycolmonomethyl (or ethyl) ether; N-methyl-2-pyrrolidone, 2-pyrrolidone, and 1,3-dimethyl-2imidazolidinone. These water-soluble organic solvents may be used singly or in combination.

The content of the water-soluble organic solvent as described above in the black ink used in the invention should preferably be within a range of from 3 to 50 wt. % in general, or more preferably from 3 to 40 wt. % relative to the total ink. A surfactant, a deforming agent, or an antiseptic may appropriately be added, in addition to the aforementioned constituents, to the black ink used in the invention, as required for achieving desired physical properties of the ink. Further, a commercially available water-soluble dye may appropriately be added.

The ink used in the invention should have properties permitting discharge from the ink-jet head. Among other ink properties, for example, viscosity should preferably be within a range of from 1 to 15 cP, on more preferably, from 1 to 5 cP, and surface tension, at least 25 dyn/cm, or more preferably, within a range of from 25 to 50 dyn/cm. A preferable composition of the water-soluble liquid medium contains, for example, glycerine, trimethyrolpropane, thiodiglycol, ethyleneglycol, diethyleneglycol, isopropylacohol, and acetylenealcohol.

The dye ink serving as color ink will now be described.

The dye ink comprises a water-soluble dye, water and a water-soluble organic solvent.

Applicable dyes include ones used in the usual ink-jet recording process such as, for example, acidic dyes and direct dyes.

As an anionic dye in the water-soluble dye used in the invention, almost any existing or newly synthesized dye is applicable so far as it has appropriate color tone and density. These dyes may be mixed. Anionic dyes include, more specifically, the following ones:

(Yellow color materials)

C.I. direct yellow 8, 11, 12, 27, 28, 28, 33, 39, 44, 50, 58, 85, 86, 87, 88, 89, 98, 100, 110;

C.I. acid yellow 1, 3, 7, 11, 17, 23, 25, 29, 36, 38, 40, 42, 44, 76, 98, 99;

C.I. reactive yellow 2, 3, 17, 25, 37, 42;

C.I. food yellow 3;

(Red color materials)

C.I. direct red 2, 4, 9, 11, 20, 23, 24, 31, 39, 46, 62, 75, 79, 80, 83, 89, 95, 197, 201, 218, 220, 224, 225, 226, 227, 228, 230;

C.I. acid red 6, 8, 9, 13, 14, 18, 26, 27, 32, 35, 42, 51, 52, 80, 83, 87, 89, 92, 106, 114, 115, 133, 134, 145, 158, 198, 249, 265, 289;

C.I. reactive red 7, 12, 13, 15, 17, 20, 23, 24, 31, 42, 45, 46, 59;

C.I. food red 87, 92, 94;

(Blue color materials)

C.I. direct blue 1, 15, 22, 25, 41, 76, 77, 80, 86, 90, 98, 106, 108, 120, 158, 163, 168, 199, 226;

C.I>acid blue 1, 7, 9, 15, 22, 23, 25, 29, 40, 43, 59, 62, 74, 78, 80, 90, 100, 102, 104, 117, 127, 138, 158, 161;

C.I. reactive blue 4, 5, 7, 13, 14, 15, 18, 19, 21, 26, 27, 29, 32, 38, 40, 44, 100.

The same water-soluble solvents and the same water as in the pigment black ink are applicable.

The content of the water-soluble organic solvent in the color ink used in the prevention would preferably be within a range of from 3 to 50 wt. % relative to the total ink, or more preferably, from 3 to 40 wt. %. The content of water in the color ink should preferably be within a range of from 50 to 90 wt. % relative to the total ink.

As in the case of the pigment black ink, the color ink as well must have properties permitting discharge from the ink jet head. Adjustment should preferably be made so that the ink has desired viscosity and surface tension.

The embodiments of the invention are achieved by supplying the storage medium recording the program codes of the software for materializing the functions of the aforementioned embodiments to the system or the apparatus, and causing the computer (or a CPU or an MPU) of the system or the apparatus to read out and execute the program codes stored in the storage medium.

In this case, the program codes themselves read out from the storage medium materialize the functions of the above-mentioned embodiments, and the storage medium storing the program codes forms the invention.

Applicable storage media for supplying the program codes include a floppy disk, a hard disk, an optical disk, a CD-ROM, a CD-R, a magnetic tape, a non-volatile memory card and an ROM.

By executing the program codes read out by the computer, the above-mentioned functions of the embodiments are materialized. In addition, it is needless to mention that an OS (operating system) operating on the computer carries out all or part of actual processing operations on the basis of an instruction of the program codes, thus realizing the functions of the embodiments.

This of course includes also the case in which after the program codes read out from the storage medium are written in memories of extensions board inserted into the computer or a extensions unit connected to the computer, a CPU provided in the extensions board or the extensions unit executes all or part of the actual processing on the basis of an instruction of the program codes, and this execution serves to materialize the functions of the above-mentioned embodiments.

According to the above description, the present invention is applied to the print apparatus of the system, among various ink-jet recording systems, which has a means (e.g., an electricity-to-heat converter or laser light) for generating heat energy as energy used to discharge an ink, and changes the state of an ink by using the heat energy. According to this system, a high-density, high-precision recording operation can be realized.

As for the typical structure and principle, it is preferable that the basic structure disclosed in, for example, U.S. Pat. Nos. 4,723,129 or 4,740,796 is employed. The aforesaid method can be adapted to both a so-called on-demand type apparatus and a continuous type apparatus. In particular, a satisfactory effect can be obtained when the on-demand type apparatus is employed because of the structure arranged in such a manner that one or more drive signals, which rapidly raise the temperature of an electricity-to-heat converter disposed to face a sheet or a fluid passage which holds the fluid (ink) to a level higher than levels at which film boiling takes place are applied to the electricity-to-heat converter in accordance with recording information so as to generate heat energy in the electricity-to-heat converter and to cause the heat effecting surface of the recording head to take place film boiling so that bubbles can be formed in the fluid (ink) to correspond to the one or more drive signals. The enlargement/contraction of the bubble will cause the fluid (ink) to be discharged through a discharging opening so that one or more droplets are formed. If a pulse shape drive signal is employed, the bubble can be enlarged/contracted immediately and properly, causing a further preferred effect to be obtained because the fluid (ink) can be discharged while revealing excellent responsibility.

It is preferable that a pulse drive signal disclosed in U.S. Pat. Nos. 4,463,359 or 4,345,262 is employed. If conditions disclosed in U.S. Pat. No. 4,313,124 which is an invention relating to the temperature rising ratio at the heat effecting surface are employed, a satisfactory recording result can be obtained.

As an alternative to the structure (linear fluid passage or perpendicular fluid passage) or the recording head disclosed in each of the aforesaid inventions and having an arrangement that discharge ports, fluid passages and electricity-to-heat converters are combined, a structure having an arrangement that the heat effecting surface is disposed in a bent region and disclosed in U.S. Pat. Nos. 4,558,333 or 4,459,600 may be employed. In addition, the following structures may be employed: a structure having an arrangement that a common slit is formed to serve as a discharge section of a plurality of electricity-to-heat converters and disclosed in Japanese Patent Laid-Open No. 59-123670; and a structure disclosed in Japanese Patent Laid-Open No. 59-138461 in which an opening for absorbing pressure waves of heat energy is disposed to correspond to the discharge section.

Furthermore, as a recording head of the full line type having a length corresponding to the maximum width of a recording medium which can be recorded by the recording unit, either the construction which satisfies its length by a combination of a plurality of recording heads as disclosed in the above specifications or the construction as a single full line type recording head which has integrally been formed can be used.

In addition, the invention is effective for a recording head of the freely exchangeable chip type which enables electrical connection to the recording unit main body or supply of ink from the main device by being mounted onto the apparatus main body, or for the case by use of a recording head of the cartridge type provided integrally on the recording head itself.

It is preferred to additionally employ the recording head restoring means and the auxiliary means provided as the component of the present invention because the effect of the present invention can be further stabled. Specifically, it is preferable to employ a recording head capping means, a cleaning means, a pressurizing or suction means, an electricity-to-heat converter, an another heating element or sub-heating means constituted by combining them and a sub-emitting mode in which an emitting is performed independently from the recording emitting in order to stably perform the recording operation.

Although a fluid ink is employed in the aforesaid embodiment of the present invention, an ink which is solidified at the room temperature or lower and as well as softened at the room temperature, an ink in the form of a fluid at the room temperature, or an ink which is formed into a fluid when the recording signal is supplied may be employed because the aforesaid ink-jet method is ordinarily arranged in such a manner that the temperature of ink is controlled in a range from 30° C. or higher to 70° C. or lower so as to make the viscosity of the ink to be included in a stable discharge range.

Furthermore, an ink which is solidified when it is caused to stand, and liquified when heat energy is supplied in accordance with a recording signal can be adapted to the present invention to positively prevent a temperature rise caused by heat energy by utilizing the temperature rise as energy of state transition from the solid state to the liquid state or to prevent ink evaporation. In any case, an ink which is liquified when heat energy is supplied in accordance with a recording signal so as to be discharged in the form of fluid ink, or an ink which is liquified only after heat energy is supplied, e.g., an ink which starts to solidify when it reaches a recording medium, can be adapted to the present invention. In the aforesaid case, the ink may be of a type which is held as fluid or solid material in a recess of a porous sheet or a through hole at a position to face the electricity-to-heat converter as disclosed in Japanese Patent Laid-Open No. 54-56847 or Japanese Patent Laid-Open No. 60-71260. It is the most preferred way for the ink to be adapted to the aforesaid film boiling method.

According to the present invention, as described above, a particular kind of ink to be used is selected in response to the type of the medium to be printed and the printing mode. It is therefore possible to record a high-quality image by making full use of ink properties.

By utilizing properties of the pigment ink, it is possible to record an image having a sufficient print density and sharp edges and excellent in fastness.

Further, it is possible to improve density of a black region by mixing pigment ink and dye ink at a prescribed ratio to form the black region.

The present invention is not limited to the above embodiments and various changes and modifications can be made within the spirit and scope of the present invention. Therefore, to apprise the public of the scope of the present invention the following claims are made.

What is claimed is:

1. An ink jet recording method for recording an image onto a recording medium by using a pigment-based black ink including a black pigment and dye-based color inks including at least cyan, magenta and yellow dyes, without including a black dye, comprising the steps of:

providing the recording medium having a substrate and an ink receiving layer provided onto a side of the substrate, the recording medium being viewed from a side opposite to the substrate to the surface having said ink receiving layer; and performing recording onto the recording medium using said dye-based color inks alone without using said pigment-based black ink, if any of a monochromatic image and a color image of a plurality of colors is recorded onto the recording medium.

2. An ink jet recording apparatus for recording an image onto a recording medium by scanning an ink jet head having discharge portions for discharging a pigment-based black ink including a black pigment and dye-based color inks including at least cyan, magenta and yellow dyes, without including a black dye, relative to the recording medium, comprising:

driving means for driving the ink jet head such that recording is performed using the dye-based color inks discharge portions alone without using the pigment-based black ink discharge portion, if it is determined that the recording medium is the recording medium having a substrate and an ink receiving layer provided onto a side of the substrate, the recording medium is to be viewed from a side opposite to the substrate to the surface having said ink receiving layer.

3. An ink-jet recording apparatus according to claim 2, wherein:

said discharge portion has a heat energy generator imparting a heat energy for discharging ink.

4. An ink jet recording method for recording an image onto a recording medium by using a pigment-based black ink including a black pigment and dye-based color inks including at least cyan, magenta and yellow dyes, without including a black dye, comprising the steps of:

providing a light-transmissive recording medium having an ink receiving layer; and recording a black region onto the recording medium using the pigment-based black ink with the dye-based color inks.

5. An ink jet recording apparatus for recording an image onto a recording medium by scanning an ink jet head having discharge portions for discharging a pigment-based black ink including a black pigment and dye-based color inks including at least cyan, magenta and yellow dyes, without including a black dye, relative to the recording medium, the apparatus comprising:

driving means for driving the ink jet head such that a black region is recorded using the pigment-based black ink discharge portion with the dye-based color ink discharge portion, if the black region is recorded onto a light-transmissive recording medium having an ink receiving layer.

6. An ink-jet recording apparatus according to claim 5, wherein:

said discharge portion has a heat energy generator imparting a heat energy for discharge of the ink.

7. An ink jet recording method for recording an image onto a recording medium by using a pigment-based black ink including a black pigment and dye-based color inks including at least cyan, magenta and yellow dyes, without including a black dye, comprising the steps of:

providing a glossy recording medium having an ink receiving layer provided onto an opaque substrate, and performing recording onto the glossy recording medium using the pigment-based black ink alone without using the dye-based color inks if a monochromatic image is recorded onto the glossy recording medium, recording onto the glossy recording medium using the dye-based color inks alone without using the pigment-based black ink if a color image of a plurality of colors is recorded onto the glossy recording medium.

8. An ink-jet recording method according to claim 7, wherein:

the ink receiving layer provided on said opaque substrate has a glossy surface.

9. An ink-jet recording method according to claim 8, wherein:

said substrate is paper or a film.

10. An ink jet recording apparatus for recording an image onto a recording medium by scanning an ink jet head having discharge portions for discharging a pigment-based black ink including a black pigment and dye-based color inks including at least cyan, magenta and yellow dyes, without including a black dye, relative to the recording medium, comprising:

driving means for driving the ink jet head such that recording is performed using the pigment-based black ink discharge portion alone without using the dye-based color inks discharge portion if a monochromatic image is recorded onto a glossy recording medium having an ink receiving layer provided onto an opaque substrate, recording is performed using the dye-based color inks discharge portion alone without using the pigment-based black ink discharge portion if a color image of a plurality of colors is recorded onto the glossy recording medium.

11. An ink-jet recording apparatus according to claim 10, wherein:

the ink receiving layer provided on said opaque substrate has a glossy surface.

12. An ink-jet recording apparatus according to claim 11, wherein:

said substrate is paper or a film.

13. An ink-jet recording apparatus according to claim 11, wherein:

said monochromatic image is an image including at least black characters and black lines.

14. An ink-jet recording apparatus according to claim 10, wherein:

said discharge portion has a heat energy generator imparting a heat energy to the ink for discharge.

15. An ink-jet recording method comprising the steps of preparing a pigment-based black ink including a black pigment and dye-based color ink including at least cyan, magenta and yellow dyes, without including a black dye, and recording an image on a recording medium; wherein:

(a) when conducting recording on a recording medium having an ink receiving layer provided on a substrate, having a glossy surface:

said pigment-based black ink alone is used without the use of said dye-based color ink when recording a monochromatic image on said glossy recording medium; and said dye-based color ink alone is used without the use of said pigment-based black ink when recording a color image of a plurality of colors on said glossy recording medium;

(b) when conducting recording on an OHP sheet:

recording is accomplished by the simultaneous use of said pigment-based black ink and said dye-based color ink when recording any of a monochromatic image or a color image of a plurality of colors on said OHP sheet;

(c) when conducting recording on a postcard:

said pigment-based black ink alone is used without the use of said dye-based color ink when recording a monochromatic image on said postcard; and recording is accomplished by the simultaneous use of said pigment-based black ink and said dye-based color ink when recording a color image of plurality of colors on said postcard; and (d) when conducting recording on a recording medium having an ink receiving layer on a side of the substrate for viewing from a side opposite to the surface having said ink receiving layer;

recording is accomplished by using said dye-based color ink alone without the use of said pigment-based black ink when recording any of a monochromatic image and a color image of a plurality of colors on a recording medium for viewing from a side opposite to the surface having said ink receiving layer.

16. An ink-jet recording apparatus for recording an image on a recording medium by scanning a discharge section discharging a pigment-based black ink including a black pigment and another discharge section discharging dye-based color ink including at least cyan, magenta and yellow dyes, without including a black dye, relative to the recording medium; wherein said ink-jet recording apparatus has recording control means controlling performance of recording in any of the following first to fourth recording modes:

(a) when conducting recording on the recording medium having an ink receiving layer, having a glossy surface, on a substrate, a first recording mode of conducting recording, when recording a monochromatic image on said glossy recording medium, by using said pigment-based black ink discharge section alone without the use of said dye-based color ink discharge section; and conducting recording, when recording a color image of a plurality of colors on said glossy recording medium, by using said dye-based color ink discharge section alone without the use of said pigment-based black ink discharge section;

(b) when conducting recording on an OHP sheet, a second recording mode of conducting recording), when recording any of a monochromatic image and a color image of a plurality of colors, by the simultaneous use of said pigment-based black ink discharge section and said dye-based color ink discharge section;

(c) when conducting recording on a postcard, a third recording mode of conducting recording, when recording a monochromatic image on said postcard, by using said pigment-based black ink discharge section alone without the use of said dye-based color ink discharge section; and conducting recording, when recording a color image of a plurality of colors on said postcard, by the simultaneous use of said pigment-based black ink discharge section and said dye-based color ink discharge section; and (d) when conducting recording on a medium for viewing from a side opposite to the surface having said ink receiving layer provided on one side of the substrate, a fourth recording mode of conducting recording, when recording any of a monochromatic image and a color image on a recording medium to be viewed from the side opposite to the surface having said ink receiving layer, by using said dye-based color ink discharge section alone without the use of pigment-based said black ink discharge section.

17. An ink-jet recording apparatus according to claim 16, wherein:

said discharge portion has a heat energy generator imparting a heat energy for discharge of ink.

18. A method of controlling an ink jet recording apparatus recording an image onto a recording medium by scanning an ink jet head having discharge portions for discharging a pigment-based black ink including a black pigment and dye-based color inks including at least cyan, magenta and yellow dyes, without including a black dye, relative to the recording medium, comprising the steps of:

providing the recording medium having a substrate and an ink receiving layer provided onto a side of the substrate, the recording medium being viewed from a side opposite to the substrate to the surface having said ink receiving layer; and controlling the ink jet recording apparatus such that recording onto the recording medium is performed using said dye-based color inks alone without using said pigment-based black ink, if any of a monochromatic image and a color image of a plurality of colors is recorded onto the recording medium.

19. A machine-readable storing medium storing program code for executing reading control processing of an ink jet recording system for recording an image onto a recording medium by scanning an ink jet head having discharge portion for discharging a pigment-based black ink including a black pigment and dye-based color inks including at least cyan, magenta and yellow dyes, without including a black dye, relative to the recording medium, comprising:

program code for controlling the ink jet head such that recording is performed using the dye-based color inks discharge portions alone without using the pigment-based black ink discharge portion, if it is determined that the recording medium type is the recording medium having a substrate and an ink receiving layer provided onto a side of the substrate, the recording medium is to be viewed from a side opposite to the substrate to the surface having said ink receiving layer.

20. A method of controlling an ink jet recording apparatus for recording an image onto a recording medium by scanning an ink jet head having discharge portions for discharging a pigment-based black ink including a black pigment and dye-based color inks including at least cyan, magenta and yellow dyes, without including a black dye, relative to the recording medium comprising the steps of:

providing a light-transmissive recording medium having an ink receiving layer; and controlling the ink jet recording apparatus such that recording a black region onto the recording medium is performed using the pigment-based black ink with the dye-based color inks.

21. A machine-readable storing medium storing program code for executing reading control processing of an ink jet recording system for recording an image onto a recording medium by scanning an ink jet head having discharge portions for discharging a pigment-based black ink including a black pigment and dye-based color inks including at least cyan, magenta and yellow dyes, without including a black dye, relative to the recording medium, comprising:

program code for controlling the ink jet head such that recording a black region onto a light-transmissive recording medium having an ink receiving layer is performed using the pigment-based black ink with the dye-based color inks.

22. A method of controlling an, ink jet recording apparatus for recording an image onto a recording medium by scanning an ink jet head having discharge portions for discharging a pigment-based black ink including a black pigment and dye-based color inks including at least cyan, magenta and yellow dyes, without including a black dye, relative to the recording medium, comprising the steps of:

providing a glossy recording medium having an ink receiving layer provided onto an opaque substrate; and controlling the ink jet recording apparatus such that recording onto the glossy recording medium is performed using the pigment-based black ink alone without using the dye-based color inks when a monochromatic image is recorded onto the glossy recording medium, recording onto the glossy recording medium is performed using the dye-based color inks alone without using the pigment-based black ink when a color image of a plurality of colors is recorded onto the glossy recording medium.

23. A control method of an ink-jet recording apparatus according to claim 22, wherein:

the ink receiving layer provided on said opaque substrate has a glossy surface.

24. A machine-readable storing medium storing program code for executing reading control processing of an ink jet recording system for recording an image onto a recording medium by scanning an ink jet head having discharge portions for discharging a pigment-based black ink including a black pigment and dye-based color inks including at least cyan, magenta and yellow dyes, without including a black ink, relative to the recording medium, comprising:

program code for controlling the ink jet head such that recording onto the recording medium is performed using the pigment-based black ink alone without using the dye-based color inks if a monochromatic image is recorded onto a glossy recording medium, recording onto the recording medium is performed using the dye-based color inks alone without using the pigment-based black ink if a color image of a plurality of colors is recorded onto the glossy recording medium.

25. A machine-readable storing medium according to claim 24, wherein:

the ink receiving layer provided on said opaque substrate has a glossy surface.

* * * * *

UNITED STATES PATENT AND TRADEMARK OFFICE

CERTIFICATE OF CORRECTION

PATENT NO. : 6,336,705 B1
DATED : January 8, 2002
INVENTOR(S) : Makoto Torigoe

It is certified that error appears in the above-identified patent and that said Letters Patent is hereby corrected as shown below:

Column 1,
Line 15, “comprise” should read -- comprises --.

Column 2,
Line 14, “aggregate” should read -- aggregates --;
Line 15, “solidify” should read -- solidifies --;
Line 29, “glossy” should read -- gloss --; and
Line 37, “This” should read -- This is --.

Column 3,
Line 1, “dried.” should read -- dry. --;
Line 7, “the both” should read -- both the --;
Line 8, “on a” should read -- on an --;
Line 16, “a” should be deleted;
Line 17, “medium” should read -- media --;
Line 21, “excellent” should read -- excellence --; and
Line 35, “layer:” should read -- layer; --.

Column 4,
Line 2, “areas” should read -- area --;
Line 25, “areas” should read -- area --; and
Line 51, “eight” should read -- eighth --.

Column 8,
Line 16, “areas” should read -- area --.

Column 11,
Line 15, “glossy.” should read -- gloss. --;
Line 17, “slither” should read -- slighter --;
Line 22, “as” should read -- is --; and
Line 25, “glossy” should read -- gloss --.

Column 13,
Line 2, “term” should read -- term, -- and
“ink” should read -- ink, --.

UNITED STATES PATENT AND TRADEMARK OFFICE

CERTIFICATE OF CORRECTION

PATENT NO. : 6,336,705 B1
DATED : January 8, 2002
INVENTOR(S) : Makoto Torigoe

It is certified that error appears in the above-identified patent and that said Letters Patent is hereby corrected as shown below:

Column 18,
Line 61, “preferably” should read -- preferably be --.

Column 21,
Line 58, “an” should be deleted.

Signed and Sealed this

Fourth Day of March, 2003

JAMES E. ROGAN
*Director of the United States Patent and Trademark Office*